US005880702A

United States Patent [19]

Morimoto et al.

[11] Patent Number: 5,880,702

[45] Date of Patent: Mar. 9, 1999

[54] DISPLAY CONTROL APPARATUS AND METHOD

[75] Inventors: Hajime Morimoto, Tokyo; Taketo Hasegawa; Toshiyuki Nobutani, both of Yokohama; Masami Shimakura, Machida; Junichi Tanahashi, Tokyo; Kenichiro Ono, Souka; Tatsuya Nakajima, Hiratsuka; Eiichi Matsuzaki, Kawasaki, all of Japan

[73] Assignee: Canon Kabushiki Kaisha, Tokyo, Japan

[21] Appl. No.: 544,174

[22] Filed: Oct. 17, 1995

[30] Foreign Application Priority Data

Oct. 20, 1994 [JP] Japan ..... 6-281281
Jun. 2, 1995 [JP] Japan ..... 7-136985

[51] Int. Cl.[6] ..... G09G 5/00

[52] U.S. Cl. ..... 345/1; 345/185; 345/189; 345/190

[58] Field of Search ..... 345/185, 200, 345/1, 189, 190

[56] References Cited

U.S. PATENT DOCUMENTS

| | | | |
|---|---|---|---|
| 4,688,190 | 8/1987 | Bechtolsheim | 364/900 |
| 4,815,033 | 3/1989 | Harris | 345/185 |
| 4,845,661 | 7/1989 | Shimada | 345/200 |
| 5,526,025 | 6/1996 | Selwan et al. | 345/200 |
| 5,602,567 | 2/1997 | Kanno | 345/185 |

FOREIGN PATENT DOCUMENTS

| | | |
|---|---|---|
| 0456923 | 11/1991 | European Pat. Off. . |
| 0533472 | 3/1993 | European Pat. Off. . |
| 0571878 | 12/1993 | European Pat. Off. . |
| 0591683 | 4/1994 | European Pat. Off. . |
| 62-076357 | 4/1987 | Japan . |
| 5323905 | 12/1993 | Japan . |

*Primary Examiner*—Mark K. Zimmerman
*Assistant Examiner*—Ronald Laneau
*Attorney, Agent, or Firm*—Fitzpatrick, Cella, Harper & Scinto

[57] ABSTRACT

An image is displayed in an optimum state in accordance with the state of a display. For this purpose, an FLCD interface mounted in an information processing apparatus and an FLCD for actually displaying an image are connected through a data transfer bus for transferring image data to be displayed and a serial communication line for performing communications between them. When the FLCD detects a change in its own state, this information is supplied to a CPU of the FLCD interface through the serial communication line. An instruction for changing, e.g., the operating mode is also transmitted from the FLCD interface to the FLCD through the serial communication line.

54 Claims, 25 Drawing Sheets

BUS
108
101
CPU/
FPU
102
ROM
110
FLCD-I/F
109
FLCD
103
DMAC
MAIN
MEMORY
111
104
INTERRUPT
CONTROLLER
KEYBOARD
AND
CONTROLLER
112
114
COMMUNICATION
MODEM
113
105
REAL-TIME
CLOCK
SERIAL
INTERFACE
115
MOUSE
116
IMAGE
SCANNER
106
HARD DISK
DRIVE
117
PARALLEL
INTERFACE
118
PRINTER
107
FLOPPY DISK
DRIVE
119
LAN
INTERFACE
120

FIG. 3A
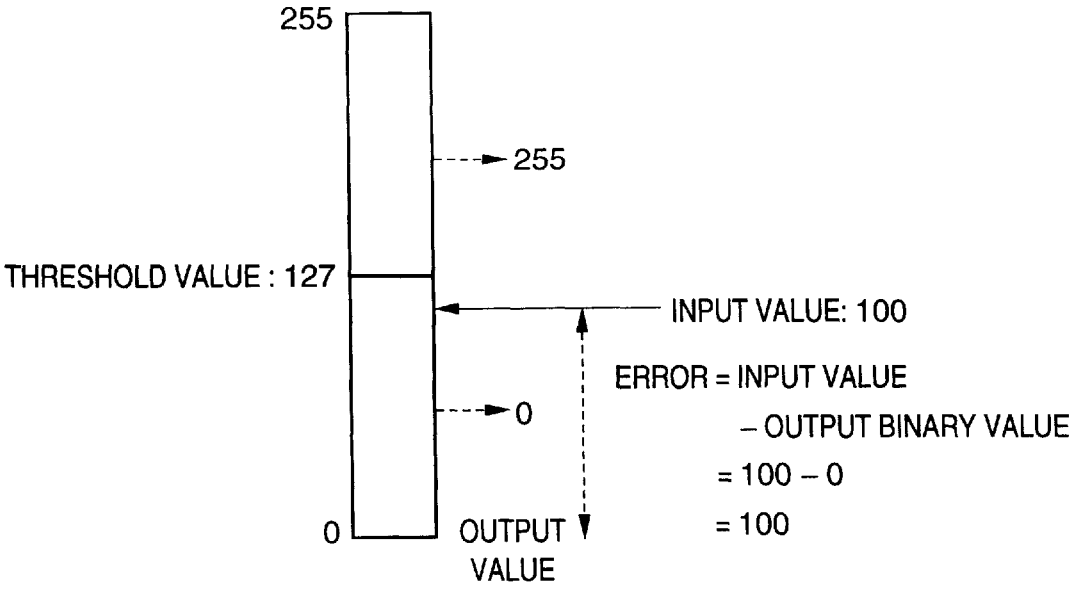
FIG. 3B
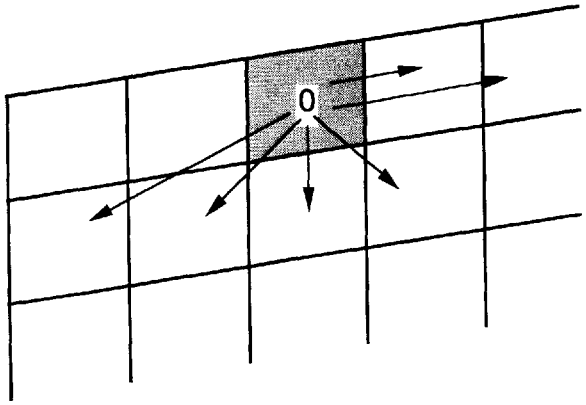
FIG. 3C
PIXEL OF INTEREST
| | | | | |
|---|---|---|---|---|
| | | * | 2/8 | 1/8 |
| 1/8 | 1/8 | 2/8 | 1/8 | |

PIXEL OF INTEREST

FIG. 5A

| | | | | |
|---|---|---|---|---|
| | | * | 2/8 | 1/8 |
| 1/8 | 1/8 | 2/8 | 1/8 | |

T1

FIG. 5B

| | | | | |
|---|---|---|---|---|
| | | * | 2/10 | 1/10 |
| 1/10 | 1/10 | 2/10 | 1/10 | |

T1

FIG. 5C

| | | | | |
|---|---|---|---|---|
| | | * | 2/12 | 1/12 |
| 1/12 | 1/12 | 2/12 | 1/12 | |

T1

FIG. 5D

| | | | | |
|---|---|---|---|---|
| | | * | 2/14 | 1/14 |
| 1/14 | 1/14 | 2/14 | 1/14 | |

T1

FIG. 5E

| | | | | |
|---|---|---|---|---|
| | | * | 2/16 | 1/16 |
| 1/16 | 1/16 | 2/16 | 1/16 | |

T1

FIG. 5F

| | | | | |
|---|---|---|---|---|
| | | * | 2/32 | 1/32 |
| 1/32 | 1/32 | 2/32 | 1/32 | |

T1

FIG. 5G

| | | | | |
|---|---|---|---|---|
| | | * | 2/64 | 1/64 |
| 1/64 | 1/64 | 2/64 | 1/64 | |

T1

FIG. 5H

| | | | | |
|---|---|---|---|---|
| | | * | 0 | 0 |
| 0 | 0 | 0 | 0 | |

T1

OUTPUT VALUE = 255 × ( INPUT VALUE / 255)$^{0.45}$

T2

| INPUT VALUE | 0 | 1 | 2 | 3 | ..... | 64 | ..... | 127 | 128 | 129 | ..... | 196 | ..... | 253 | 254 | 255 |
|---|---|---|---|---|---|---|---|---|---|---|---|---|---|---|---|---|
| OUTPUT VALUE | 0 | 21 | 28 | 34 | ..... | 137 | ..... | 186 | 187 | 188 | ..... | 255 | ..... | 254 | 255 | 255 |

OUTPUT VALUE = 255 × ( INPUT VALUE / 255)$^{0.36}$

T2

| INPUT VALUE | 0 | 1 | ..... | 64 | ..... | 128 | ..... | 196 | ..... | 254 | 255 |
|---|---|---|---|---|---|---|---|---|---|---|---|
| OUTPUT VALUE | 0 | 35 | ..... | 155 | ..... | 199 | ..... | 232 | ..... | 255 | 255 |

OUTPUT VALUE = 255 × ( INPUT VALUE / 255)$^{0.8}$

T2

| INPUT VALUE | 0 | 1 | ..... | 64 | ..... | 128 | ..... | 196 | ..... | 254 | 255 |
|---|---|---|---|---|---|---|---|---|---|---|---|
| OUTPUT VALUE | 0 | 3 | ..... | 84 | ..... | 147 | ..... | 207 | ..... | 254 | 255 |

OUTPUT VALUE = 255 × ( INPUT VALUE / 255)$^{1}$ = INPUT VALUE

T2

| INPUT VALUE | 0 | 1 | ..... | 64 | ..... | 128 | ..... | 196 | ..... | 254 | 255 |
|---|---|---|---|---|---|---|---|---|---|---|---|
| OUTPUT VALUE | 0 | 35 | ..... | 155 | ..... | 199 | ..... | 232 | ..... | 255 | 255 |

FIG. 20

| COMMAND | | STATUS | |
|---|---|---|---|
| COMMAND NAME | CODE | NORMAL | ERROR |
| Request Unit ID | 00H | 00xxxxxxB | 01xxxxxxB |
| Request 1H | 01H | 00xxxxxxB | 01xxxxxxB |
| Unit Start | 02H | 00000000B | 01xxxxxxB |
| Request Attention inf. | 03H | 00xxxxxxB | 01xxxxxxB |
| Request Attention Bit. | 04H | 00xxxxxxB | 01xxxxxxB |
| Get Mode | 05H | 00xxxxxxB | 01xxxxxxB |
| Request Status | 06H | 00xxxxxxB | 01xxxxxxB |
| Attention Clear | 0AH | 00000000B | 01xxxxxxB |
| Get Contrast Enh. | 0BH | 00xxxxxxB | 01xxxxxxB |
| Get Multi | 0CH | 00xxxxxxB | 01xxxxxxB |
| Send Diagnostic | 1xH | 00xxxxxxB | 01xxxxxxB |
| Send Host ID | 2xH | 00000000B | 01xxxxxxB |
| Set Mode | 3xH | 00000000B | 01xxxxxxB |
| Set Multi | 4xH | 00000000B | 01xxxxxxB |
| Write High Memory | 8xH | 00000000B | 01xxxxxxB |
| Write Low Memory | 9xH | 00000000B | 01xxxxxxB |
| Read High Memory | 08H | 0000xxxxB | 01xxxxxxB |
| Read Low Memory | 09H | 0000xxxxB | 01xxxxxxB |
| Set HH address | AxH | 00000000B | 01xxxxxxB |
| Set MH address | BxH | 00000000B | 01xxxxxxB |
| Set ML address | CxH | 00000000B | 01xxxxxxB |
| Set LL address | DxH | 00000000B | 01xxxxxxB |

DISPLAY CONTROL APPARATUS AND METHOD

BACKGROUND OF THE INVENTION

The present invention relates to a display device, a display control apparatus for controlling the display thereof, and an information processing apparatus including the display control apparatus.

Generally, an information processing system (or apparatus) uses a display device as a means for realizing an information visual expression function. As is well known, CRT display devices are widely used as this display device.

In display control in a CRT display device, a write operation for writing an image to be displayed into a video memory (to be referred to as a VRAM hereinafter) provided in an information processing apparatus and a read operation for reading out display data from the VRAM are independently executed.

In the above CRT display control, write access of display data to the VRAM to update display information and read access for displaying an image are independently performed. This results in an advantage in that programs of an information processing system can write desired display data at an arbitrary timing without taking account of a display timing.

Generally, however, the depth of CRT display devices increases in proportion to the display area, and consequently the volume of a whole CRT display increases more and more. That is, CRT display devices are unpreferable in respect of miniaturization because the degrees of freedom of, e.g., installation site and portability are impaired.

A liquid crystal display (to be referred to as an LCD hereinafter) is available as a display device for compensating for this drawback. This is so because the ratio of the thickness to the display area of an LCD is much smaller than that of a CRT. An example of LCDs having this property is a display (to be referred to as an FLCD hereinafter) which uses a liquid crystal cell of ferroelectric liquid crystal. One characteristic feature of the FLCD is that the liquid crystal cell holds a display state even after the end of application of an electric field. That is because the liquid crystal cell of the FLCD is sufficiently thin, and so long and narrow FLC elements in the cell maintain their respective oriented states even after the electric field is removed. The FLCD using the FLC elements with this bistability therefore has characteristics of storing the display contents. The details of the FLC and the FLCD are described in, e.g., Japanese Patent Application No. 62-76357.

In driving of the FLCD, the FLCD keeps displaying images by storing the display images, unlike CRTs or other liquid crystal displays, so a certain time margin is produced with respect to a continuous refresh driving period. As a result, in addition to this continuous refresh driving, so-called partial rewrite driving is possible by which the display state is updated only in those portions where display contents are changed.

In this manner, display is performed by the partial rewrite, i.e., by transferring only a portion in which the display contents are altered to the FLCD. Accordingly, the FLCD is required to have intelligence to a certain degree in order to receive and display the transferred image.

Also, the display speed of the FLCD slightly changes in accordance with the temperature (the higher the temperature, the higher the display speed). Therefore, it is desirable that the data transfer period change in accordance with the temperature of the FLCD. Assume, for example, that the FLCD is used as a display of an information processing apparatus such as a personal computer, and that only a portion in which the display contents are altered is transferred to the FLCD with the information processing apparatus previously switched on. In this case, if the FLCD is switched on at that moment, only the transferred partial image is displayed, i.e., an overall image cannot be displayed.

That is, normal images cannot be displayed if the information processing apparatus one-sidedly transfers display image data to the FLCD. Accordingly, some communications must be performed bidirectionally.

On the other hand, the faster the transfer of display image data to the FLCD, the better the transfer. Unfortunately, bidirectional communications through a bus unavoidably sacrifice the transfer rate of display image data.

Also, an image display device displays image information (including character image information) supplied from an image supply device such as a host computer. Such an image display device is usually so designed that image adjustment, e.g., contrast adjustment and brightness adjustment, can be performed in real time in accordance with the display contents or the external environment, such as an illumination state, by manipulating a slide switch or a dial switch.

Two methods are available as the method of performing this image adjustment. In the first method, an input means, such as a slide switch or a dial switch, for inputting an image adjustment instruction signal is provided in an image display device. On the basis of the input image adjustment instruction signal from this input means, the image display device changes an image display parameter. In the second method, this input means for inputting the image adjustment instruction signal is provided in an image supply device such as a host computer. On the basis of the input image adjustment instruction signal from the input means, the image supply device changes an image processing parameter for producing image information to be supplied to the image display device.

Unfortunately, in the first method, it is impossible to perform fine image processing (image adjustment) because the image display device singly changes the image display parameter.

In the second method, on the other hand, fine image processing can be performed by the image supply device. However, if the image supply device and the image display device are installed apart from each other, it is difficult for a user to input an image adjustment instruction signal while monitoring the display screen. This makes smooth image adjustment impossible.

SUMMARY OF THE INVENTION

The present invention has been made in consideration of the above problems, and has as its object to provide a display device, a display control apparatus, and an information processing apparatus using the display control apparatus, by which images can be displayed in an optimum state in accordance with the condition of the display device.

To achieve the above object, a display control apparatus of the present invention for controlling a display for displaying transferred image data while communicating with an external apparatus comprises image data transfer means for transferring a display image to the display through a first bus, and communicating means for bidirectionally transmitting and receiving data to and from the display through a second bus, wherein status information from the display is received and a command for changing a driving state of the display is transmitted through the second bus.

According to one preferred embodiment of the present invention, the display is a device having a function of holding an image display state, e.g., a ferroelectric liquid crystal display. Consequently, images can be displayed by fully utilizing the characteristic feature of the holding function.

The second bus is preferably a serial bus. In this case, the second bus is not required to have as a high transfer rate as that of the first bus. Accordingly, it is possible to reduce the cost and the number of signal lines.

It is desirable that the display comprise at least detecting means for detecting a temperature near a display element and contrast changing means for changing a contrast of a display screen, and that the status information include information based on the detected temperature and information based on the changed contrast. Consequently, images can be displayed in an optimum state in accordance with the status of the display.

The apparatus preferably further comprises first storage means for storing original image data of a display image, second storage means for storing data having a display format of the display, monitoring means for monitoring an access to the first storage means, converting means for, if the monitoring means detects that write access is performed to the first storage means, converting image data in the written area into the display data format of the display, storing means for storing the converted image data into the second storage means, determining means for determining whether the second storage means has an image untransferred to the display, and output means for, if the determining means determines that the second storage means has an untransferred image, outputting the image to the display through the first bus.

With this arrangement, only a changed portion is transferred and displayed, so it is possible to display images at a high speed.

It is desirable that the second storage means have a capacity of a full-screen image displayed by the display, and that the apparatus further comprise second output means for outputting all images stored in the storage means to the display through the first bus, if the determining means determines that the second storage means has no untransferred image. Consequently, a partial image which remains unchanged can be reliably displayed in a natural state.

The second output means preferably performs interlaced scanning of images stored in the second storage means and outputs the scanned images to the display. This makes it possible to increase an apparent updating rate even if the display updating rate is low.

The output means preferably comprises means for transferring all images stored in the second storage means at a ratio based on the status information from the display within a predetermined time. With this arrangement, a full-screen image is refreshed in accordance with the status information even if a moving image is displayed in a portion of the screen. Accordingly, natural images can be displayed at any instant.

It is desirable that the display control apparatus be connected to an extended bus provided in a general-purpose information processing apparatus. Consequently, the display can be used with different types of widely used apparatuses.

It is another object of the present invention to allow an operator to smoothly perform fine image adjustment while the operator is monitoring the display screen.

To achieve the above object, a display control system of the present invention having an image supply device for supplying image information while performing image processing, and an image display device for displaying the image information supplied from the image supply device, comprises input means, provided in the image display device, for inputting an image adjustment instruction signal, transfer means for transferring the input image adjustment instruction signal from the input means to the image supply device, and changing means, provided in the image supply device, for changing an image processing parameter on the basis of the transferred image adjustment instruction signal from the transfer means.

In this arrangement, when the input means provided in the image display device inputs the image adjustment instruction signal, the transfer means transfers the input image adjustment instruction signal to the image supply device. The changing means provided in the image supply device changes the image processing parameter on the basis of the transferred image adjustment instruction signal from the transfer means. Accordingly, an operator can smoothly perform fine image adjustment while monitoring the display screen.

To achieve the above object, the image processing parameter is a coefficient for degamma processing. The changing means changes this degamma processing coefficient as an image processing parameter on the basis of the transferred image adjustment instruction signal from the transfer means. Consequently, an operator can smoothly perform fine image adjustment while monitoring the display screen.

To achieve the above object, the image processing parameter is a coefficient for error diffusion processing. The changing means changes this error diffusion processing coefficient as an image processing parameter on the basis of the transferred image adjustment instruction signal from the transfer means. Consequently, an operator can smoothly perform fine image adjustment while monitoring the display screen.

To achieve the above object, the transfer means transfers the image adjustment instruction signal by serial communication. By transferring the image adjustment instruction signal by serial communication, the transfer means allows an operator to smoothly perform fine image adjustment while the operator is monitoring the display screen.

To achieve the above object, the transfer means transfers the image adjustment instruction signal by parallel communication. By transferring the image adjustment instruction signal by parallel communication, the transfer means allows an operator to smoothly perform fine image adjustment while the operator is monitoring the display screen.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 3A to 3C are views for explaining error diffusion processing;

FIGS. 5A to 5H are views showing an example of the contents of the error diffusion tables;

FIG. 20 is a view showing the list of commands supplied from the FLCD interface to the FLCD in the fourth embodiment;

DETAILED DESCRIPTION OF THE PREFERRED EMBODIMENTS

Embodiments of the present invention will be described below with reference to the accompanying drawings.

First Embodiment

Figure 1:
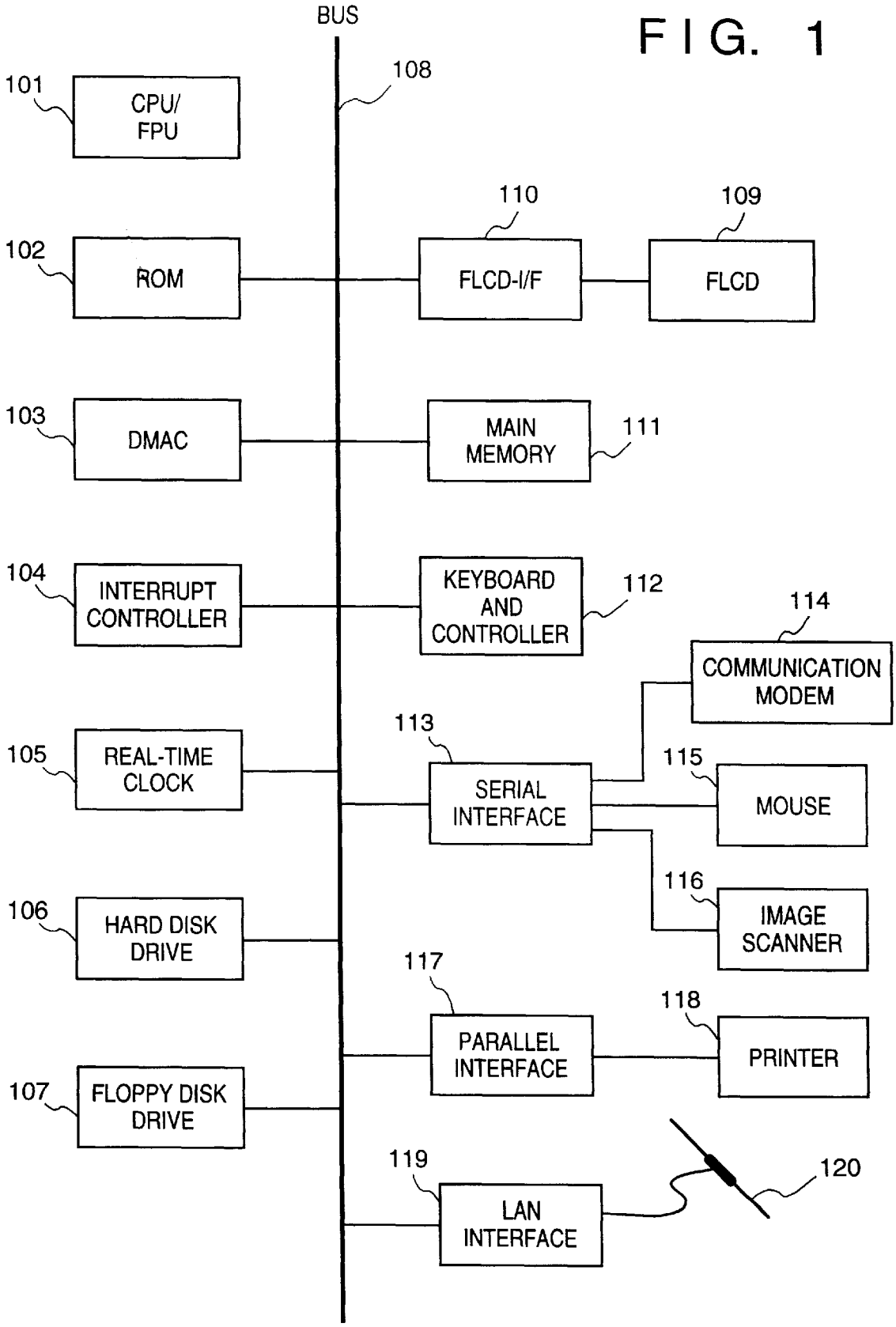
FIG. 1 is a block diagram showing a schematic arrangement of an information processing system using a display control system according to an embodiment of the present invention.

FIG. 1 is a block diagram showing a schematic arrangement of an information processing system using a display control system according to the first embodiment of the present invention.

In FIG. 1, reference numeral 101 denotes a host CPU for controlling a whole information processing system (e.g., a personal computer) and an FPU for performing numerical computation necessary for predetermined control and data processing. A ROM 102 stores a program (boot program) for activating this information processing system and control program codes for controlling a part of hardware. A DMA controller 103 (to be also referred to as a DMAC hereinafter) performs a high-speed data transfer between memories and between a main memory 111 and various devices constituting the information processing system independently of the host CPU 101.

An interrupt controller 104 controls interrupt requests from various devices constituting the information processing system. A real-time clock 105 includes a quartz oscillator and counts accurate clocks of the oscillator. Reference numeral 106 denotes a hard disk drive as an external storage and its interface; 107, a floppy disk drive as an external storage and its interface; and 108, a system bus consisting of a data bus, a control bus, and an address bus.

An FLC display 109 (to be also referred to as an FLCD hereinafter) has a display screen which uses ferroelectric liquid crystal as its display operating medium. The FLCD 109 is controlled by an FLCD-I/F 110. Although details of the FLCD-I/F 110 will be described later, the FLCD-I/F 110 incorporates a display VRAM and processing circuits for causing the FLCD 109 to display images stored in the VRAM. The main memory 111 stores the control program codes of the information processing system and various data. Reference numeral 112 denotes a keyboard for inputting character information and control information and a controller for controlling the keyboard input; 113, a serial interface between the information processing system and a communication modem 114, a mouse 115, and an image scanner 116; 117, a parallel interface between a printer 118 and the information processing system; and 119, a LAN interface between a LAN 120 such as Ethernet (R) (a LAN having a bus structure jointly developed by Xerox, DEC, and Intel) and the information processing system.

In the information processing system manufactured by connecting the various devices described above, a user performs operations while monitoring various information displayed on the display screen of the FLCD 109. That is, character information and image information supplied from the LAN 120, the communication modem 113, the mouse 115, the image scanner 116, the hard disk drive 106, the floppy disk drive 107, and the keyboard 112 and operation information pertaining to a user's system operation stored in the main memory 111 are displayed on the display screen of the FLCD 109. The user edits information or inputs instructions to the system while monitoring the display contents.

Figure 2:
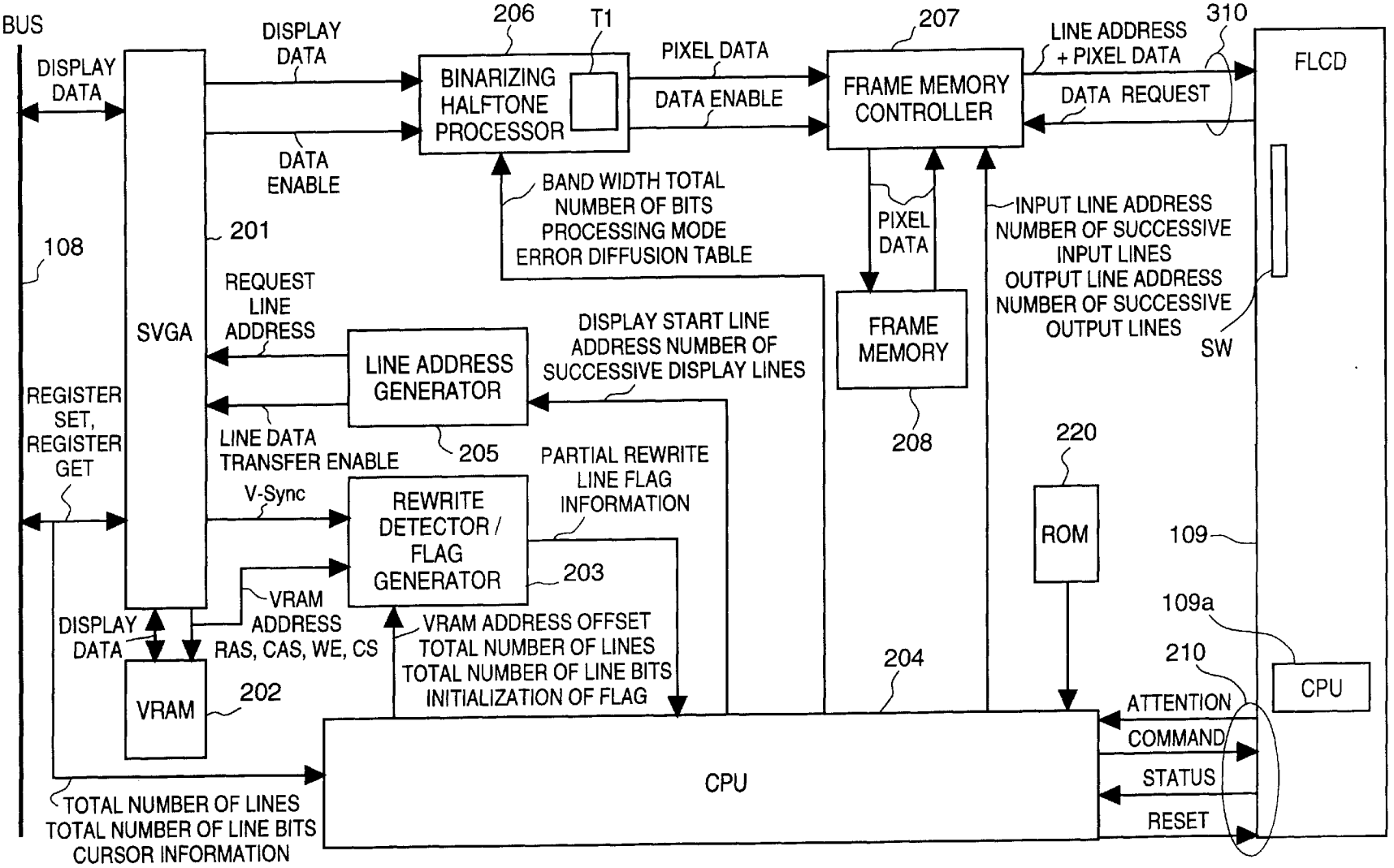
FIG. 2 is a block diagram showing the arrangement of an image supply device (FLCD-I/F) according to the first embodiment of the present invention.

FIG. 2 is a block diagram showing the arrangement of the FLCD-I/F 110 in the first embodiment. Referring to FIG. 2, the host CPU 101 (FIG. 1) transfers display data to a VRAM 202 through the system bus 108 and a SVGA 201. This display data is 24-bit data which expresses each of colors R, G, and B in 256 gradation levels. The SVGA 201 reads out display data from the VRAM 202, which is specified by a request address line transferred from a line address generator 205, in accordance with a line data transfer enable signal similarly transferred from the line address generator 205.

The SVGA 201 transfers the read-out data to a binarizing halftone processor 206.

A rewrite detector/flag generator 203 monitors a VRAM address generated by the SVGA 201 and fetches a VRAM address when the display data of the VRAM 202 is rewritten (written), i.e., a VRAM address when a write enable signal and a chip select signal CS become "1". The rewrite detector/flag generator 203 converts this VRAM address into a line address and sets an internal partial rewrite line flag register in accordance with this line address.

A CPU 204 reads out the contents of the partial rewrite line flag register of the rewrite detector/flag generator 203 and sends a line address at which this flag is set to the SVGA 201 via the line address generator 205. If partial rewrite access is to be performed to a plurality of lines, the CPU 204 sends the first line address pertaining to the partial rewrite and the number of continuous lines to the SVGA 201. At the same time, the line address generator 205 sends the line data transfer enable signal to the SVGA 201 in accordance with the address data, causing the SVGA 201 to transfer display data at the address to the binarizing halftone processor 206.

The binarizing halftone processor 206 converts the 256-gradation-level multivalue display data, which expresses each of R, G, and B by eight bits, into binary pixel data corresponding to the display screen of the FLCD 109. In this embodiment, each pixel of the display screen of the FLCD 109 consists of three dots, one each of R, G, and B. Also, this embodiment employs an error diffusion method (ED method) as the binarizing technique.

The error diffusion method will be described below with reference to FIGS. 3A to 3C. As illustrated in FIG. 3A, in the error diffusion method, input data (0 to 255) is compared with a threshold value "127". If the data is smaller than the threshold value, "0" is output; if the data is larger than the threshold value, "1" is output. A halftone is expressed by diffusing the error produced between the input value and the output value into non-binary pixels, indicated by the arrows in FIG. 3B, by using weighting shown in FIG. 3C. In this embodiment, the CPU 204 sets an error diffusion table T1 which indicates the diffusion weights as illustrated in FIG. 3C. That is, the error diffusion table T1 is dynamically changeable.

The binarizing halftone processor 206 sends the generated pixel data to a frame memory controller 207 in synchronism with a data enable signal. In accordance with the data enable signal, the frame memory controller 207 stores the supplied pixel data in an input line position in a frame memory 208 which is designated by the CPU 204. Also, in accordance with a data request signal from the FLCD 109, the frame memory controller 207 reads out pixel data from an output line position in the frame memory 208 which is designated by the CPU 204, and sends the readout data to the FLCD 109. In this case, the frame memory controller 207 multiplexes the output line address designated by the CPU 204 and the pixel data and sends the resultant addressed pixel data to the FLCD 109.

The FLCD 109 displays the pixel data received from the FLCD-I/F 110 at a line position in the display panel designated by the line address. When the reception of pixel data of one line is completed and the reception of pixel data of the next line is enabled, the FLCD 109 sends the data request signal to the frame memory controller 207.

The FLCD 109 is equipped with a slide switch SW. It is possible by operating this slide switch SW to change the error diffusion tables T1 used in the error diffusion processing by the binarizing halftone processor 206, and with this change, suitable display images can be obtained in accordance with the display contents or the external environment. In this case, the operation information of the slide switch SW, i.e., the image adjustment instruction signal is supplied to the CPU 204 through a serial communication line 210.

The operation when the slide switch SW is operated will be described below with reference to FIG. 4.

Figure 4:
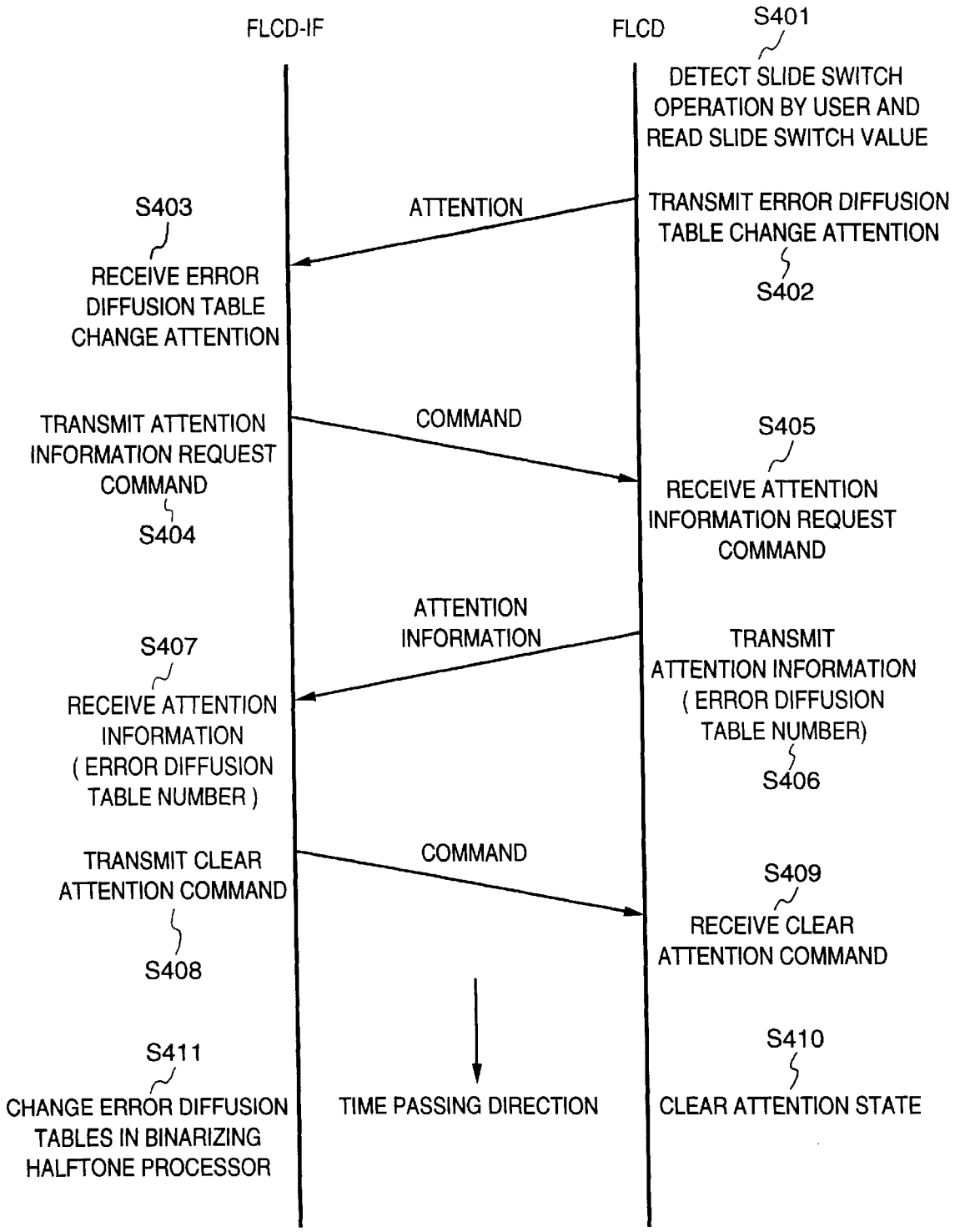
FIG. 4 is a view showing the sequence of a communication procedure for changing error diffusion tables.

When the slide switch SW is operated, communications such as shown in FIG. 4 are performed between the FLCD 109 and the FLCD-I/F 110. All these communications are done through the serial communication line 210.

First, a CPU 109*a* for controlling the FLCD 109 detects the change in the slide switch SW for changing the error diffusion tables and reads the value of the slide switch SW (S401). The CPU 109*a* transmits, to the FLCD-I/F 110, an attention indicating that a change request for the error diffusion table T1 is input (S402).

Upon receiving this attention (S403), the CPU 204 of the FLCD-I/F 110 transmits to the FLCD 109 a command for requesting detailed information of the attention, i.e., the command for requesting the error diffusion table T1 number designated by the operation of the slide switch SW (S404). When receiving this request command (S405), the CPU 109*a* of the FLCD 109 transmits the detailed information (the error diffusion table T1 number) of the attention to the FLCD-I/F 110.

The CPU 204 of the FLCD-I/F 110 receives this detailed attention information (S407) and transmits, to the FLCD 109, a clear attention command which indicates that the detailed attention information is normally received (S408). Upon receiving this clear attention command (S409), the CPU 109*a* of the FLCD 109 clears the attention state (S410) by determining that the detailed information of the attention is correctly transmitted to the FLCD-I/F 110.

The CPU 204 of the FLCD-I/F 110 which is requested to change the error diffusion tables T1 reads out the error diffusion table T1 assigned with the requested table number and sets the readout table in the binarizing halftone processor 206 (S411).

In this embodiment, eight different error diffusion tables T1 shown in FIGS. 5A to 5H are selectable. The error diffusion table T1 in FIG. 5A has the largest error diffusion coefficients (weights) and can perform a faithful halftone display. Therefore, this error diffusion table is suited to display halftone images such as natural images and gradation patterns. The error diffusion table T1 in FIG. 5H, on the other hand, has the smallest error diffusion coefficients (weights) and performs a display close to a binary display. Accordingly, this error diffusion table is suited to display binary images such as character images. The error diffusion tables T1 from FIGS. 5B to 5G are intermediate between the tables shown in FIGS. 5A and 5H. Displays done by these tables become closer to a binary display in the order of FIG. 5B→FIG. 5C→FIG. 5D→ . . . →FIG. 5G.

Consequently, by operating the slide switch SW, it is possible to select from the among the error diffusion tables T1 and obtain a suitable display image corresponding to the display contents, in real time. The slide switch SW is attached to the FLCD 109, and the FLCD-I/F 110 changes the error diffusion tables T1, i.e., changes the image generation parameters. This allows a user to smoothly perform fine image adjustment in real time while the user is monitoring a change on the display screen.

Second Embodiment

Figure 6:
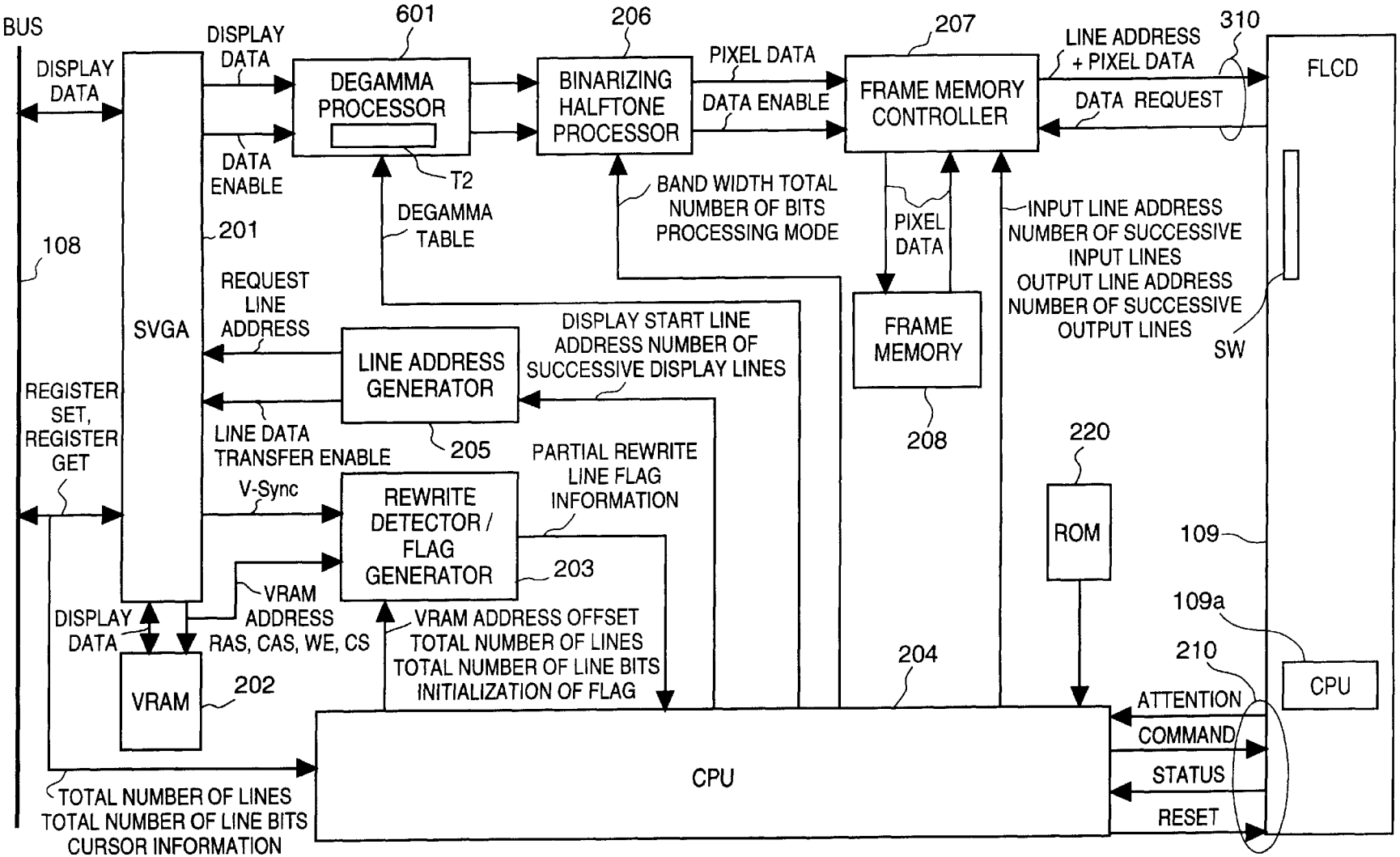
FIG. 6 is a block diagram showing the arrangement of an image supply device (FLCD-I/F) according to the second embodiment of the present invention.

In the second embodiment, degamma tables T2 for degamma processing are changed instead of changing the error diffusion tables T1 in the first embodiment. An FLCD-I/F 110 in this second embodiment is designed as illustrated in FIG. 6.

The configuration of the FLCD-I/F 110 in the second embodiment (FIG. 6) is nearly identical with the configuration of the FLCD-I/F 110 in the first embodiment (FIG. 2) so only the difference between them will be described below. Note that in FIG. 6, the same reference numerals as in FIG. 2 denote the same components.

That is, in the FLCD-I/F 110 of the second embodiment, a degamma processor 601 is additionally provided in the preceding stage of a binarizing halftone processor 206. Also, a ROM 220 stores eight different degamma tables T2 in place of the eight different error diffusion tables T1 in the first embodiment.

The degamma processor 601 performs degamma processing by which 256-gradation-level multivalue display data in which each of colors R, G, and B is expressed by eight bits is converted into another 256-gradation-level multivalue display data in accordance with converted values of the degamma table T2. This degamma processing is performed to display data, which is already gamma-processed, by correcting the data in accordance with the characteristics of a display device.

Figures 7A, 7B:
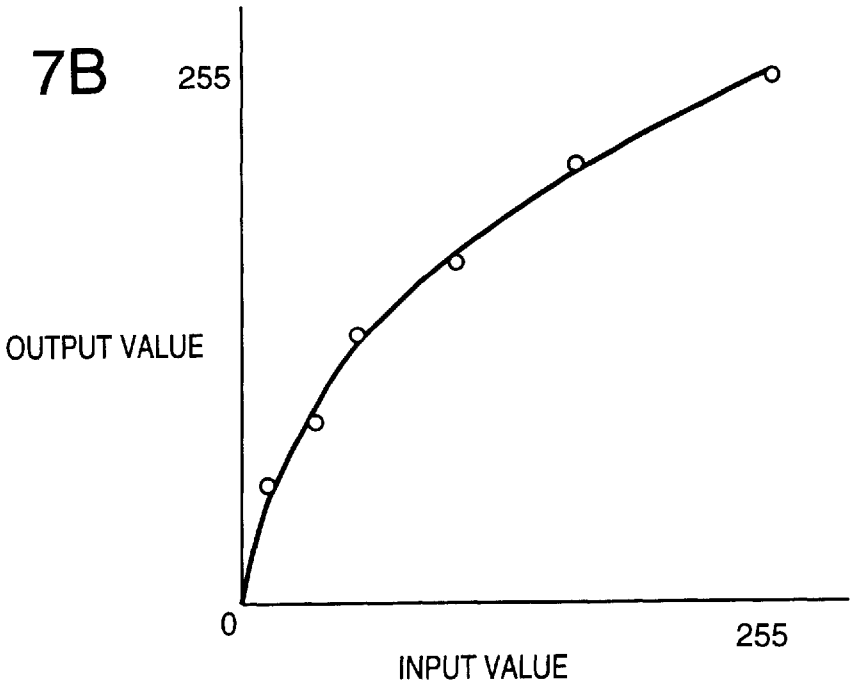
FIGS. 7A and 7B are views for explaining degamma processing.

As illustrated in FIG. 7A, the degamma table T2 records input values and output values (converted values) of the 256-gradation-level multivalue display data in which each of R, G, and B is expressed by eight bits. The degamma table T2 in FIG. 7A shows the relationship between the output value and the input value calculated by a conversion expression $$\text{output value (converted value)}=255\times(\text{input value}/255)^{0.45}$$

when a degamma coefficient is the 0.45th power. FIG. 7B shows a graph indicating this relationship between the output and input values.

In this embodiment, the degamma table T2 as shown in FIG. 7A is set by the CPU 204, and the degamma table T2 is dynamically changeable.

The degamma processor 601 sends the display data converted using the degamma table T2 to the binarizing halftone processor 206 in synchronism with a data enable signal. The processing activities by the binarizing halftone processor 206, a frame memory controller 207, and an FLCD 109 performed for this display data are analogous to those in the first embodiment.

In the second embodiment, a slide switch SW attached to the FLCD 109 is used to change the degamma tables T2 to be set in the degamma processor 601. All communications performed between the FLCD 109 and the FLCD-I/F 110 to accomplish this change are done through a serial communication line 210, as in the first embodiment.

Figure 8:
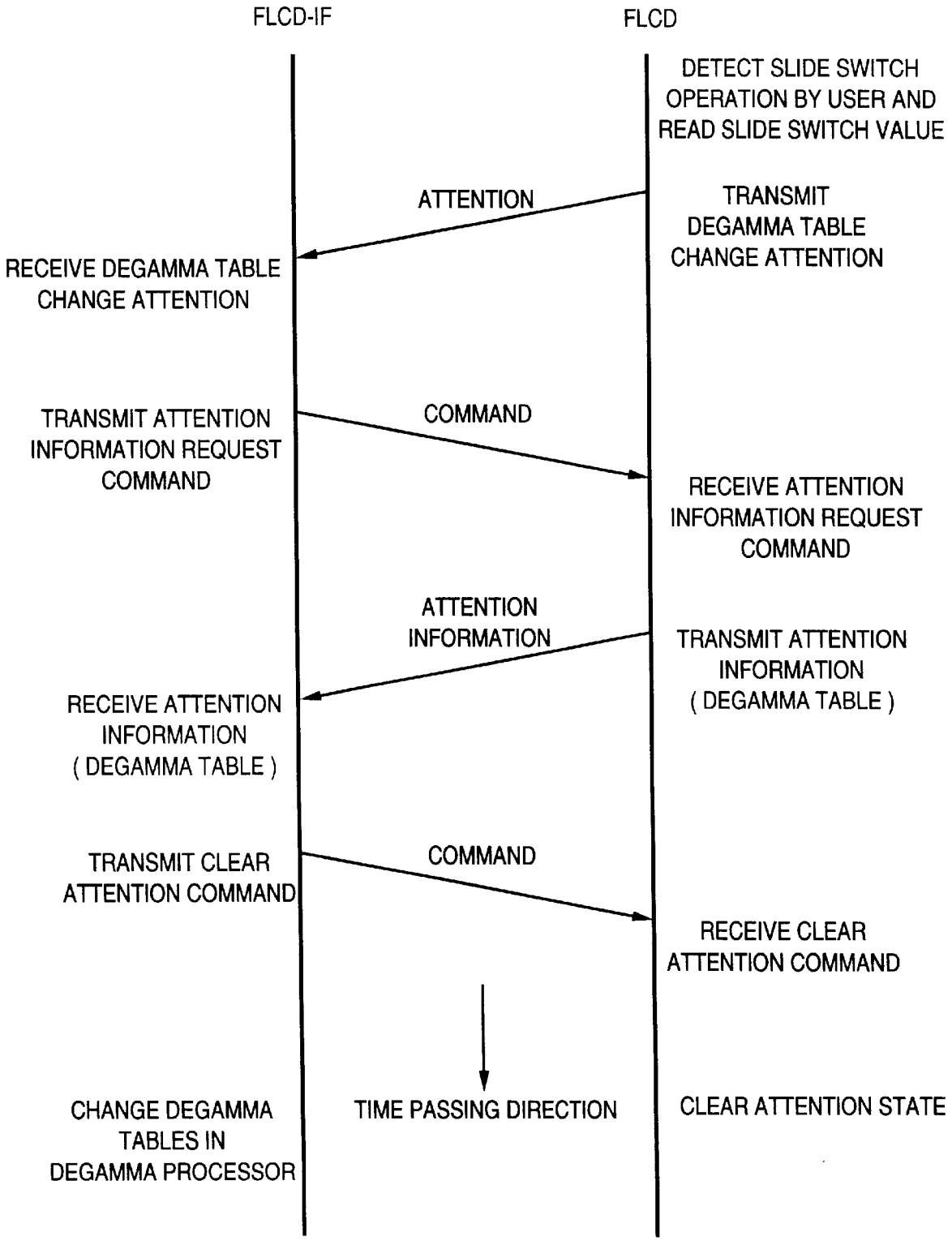
FIG. 8 is a view showing the sequence of a communication procedure for changing degamma tables.

In the second embodiment, when the slide switch SW is operated, communications are performed between the FLCD 109 and the FLCD-I/F 110 in accordance with a procedure as illustrated in FIG. 8, thereby changing the degamma tables T2 to be set in the degamma processor 601. Note that the procedure of the communication operation in the first embodiment (FIG. 4) and the procedure of the communication operation in the second embodiment (FIG. 8) are exactly the same except that objects to be changed are the degamma tables T2 in the second embodiment. Therefore, a detailed description of the procedure in the second embodiment will be omitted.

In this embodiment, the ROM 220 stores the eight degamma tables T2 based on eight degamma coefficients (0.36, 0.45, . . . , 0.8, 1). One of these degamma tables T2 is chosen in accordance with the operation of the slide switch SW and set in the degamma processor 601.

Figures 9A, 9B:
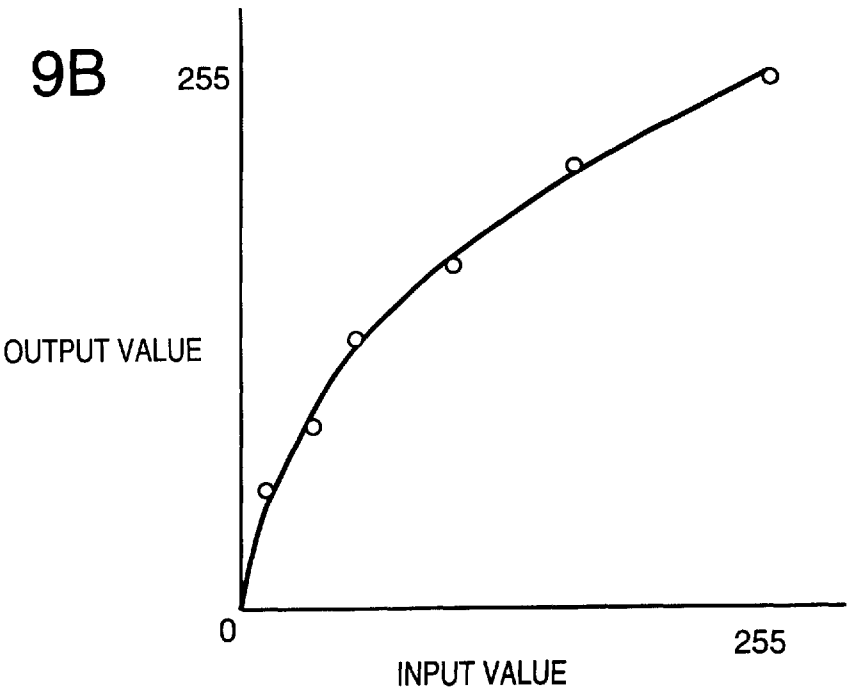
FIGS. 9A and 9B are views showing an example of the contents of the degamma table.
Figures 10A, 10B:
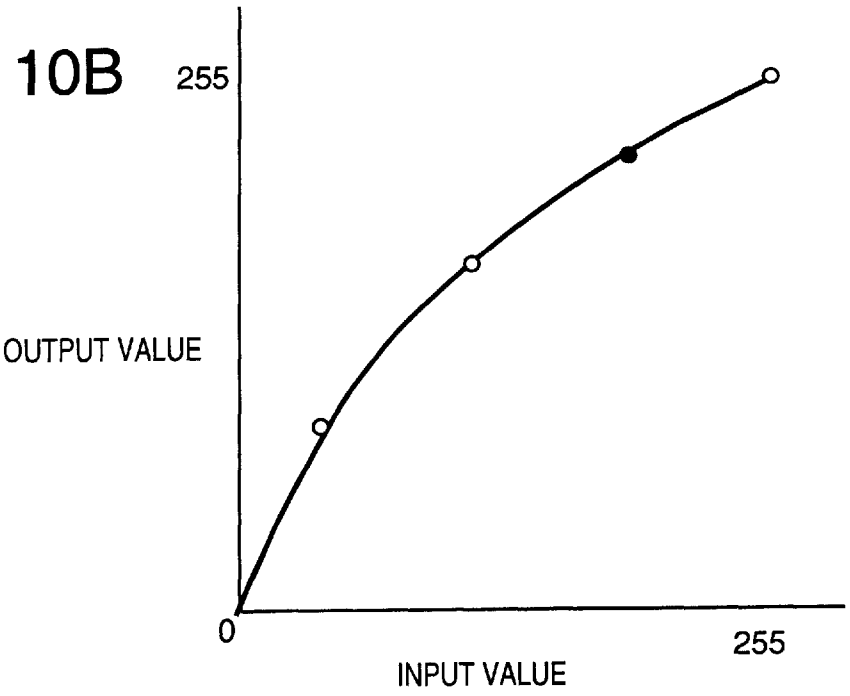
FIGS. 10A and 10B are views showing another example of the contents of the degamma table.
Figures 11A, 11B:
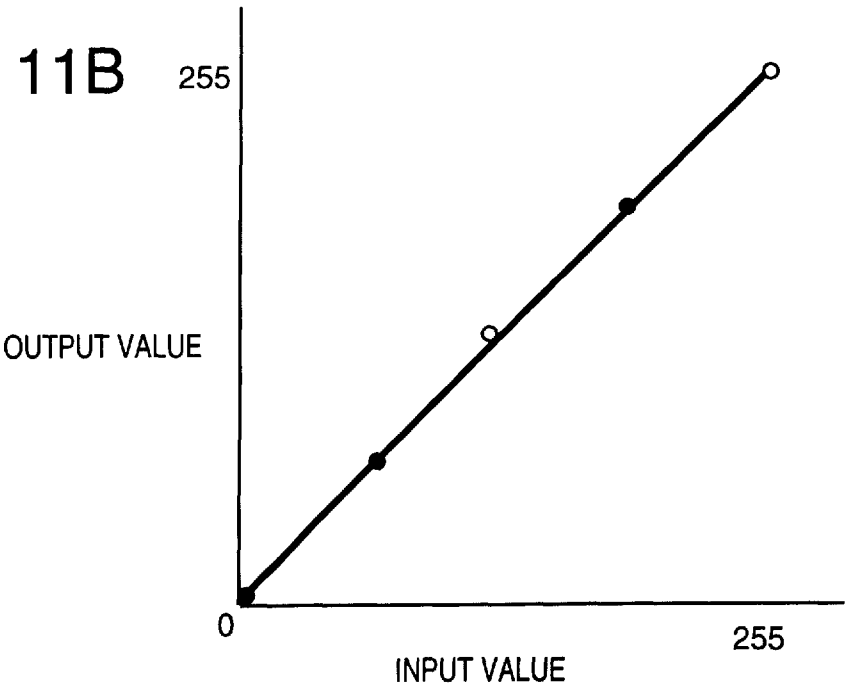
FIGS. 11A and 11B are views showing still another example of the contents of the degamma table.

The input values and the output values of the degamma tables T2 based on degamma coefficients "0.36", "0.8", and "1" are as shown in FIGS. 9A, 10A, and 11A, respectively, and the respective corresponding graphs are illustrated in FIGS. 9B, 10B, and 11B. Note that the degamma table T2 having a degamma coefficient "0.45" is illustrated in FIGS. 7A and 7B described previously.

The degamma table T2 in FIG. 9A has the smallest degamma coefficient, and so the degree of conversion is large, as shown in FIG. 9B. Therefore, this degamma table is suited to display images that are gamma-processed with large gamma coefficients. On the other hand, the degamma table T2 in FIG. 10A has a degamma coefficient close to "1", so the degree of conversion is small, as illustrated in FIG. 10B. Accordingly, this degamma table is suited to display images that are gamma-processed with small gamma coefficients. Also, the degamma table T2 in FIG. 11A has a degamma coefficient "1", and as a consequence essentially no conversion is performed, as shown in FIG. 11B. This degamma table is suited to display images that are not gamma-processed. That is, suitable images can be displayed by selecting the degamma tables T2 having smaller degamma coefficients for images gamma-processed with larger gamma coefficients.

As described above, by operating the slide switch SW in accordance with the gamma-processed state of the display contents, it is possible to change the degamma tables T2 and obtain a suitable display image in real time. The slide switch SW is attached to the FLCD 109, and the FLCD-I/F 110 selects from among the degamma tables T2, i.e., changes the image generation parameters. This allows a user to smoothly perform fine image adjustment in real time while the user is monitoring a change on the display screen.

Third Embodiment

The third embodiment performs both the processing of changing the error diffusion tables T1 in the first embodiment and the processing of changing the degamma tables T2 in the second embodiment. An FLCD-I/F 110 in this third embodiment is designed as illustrated in FIG. 12.

Figure 12:
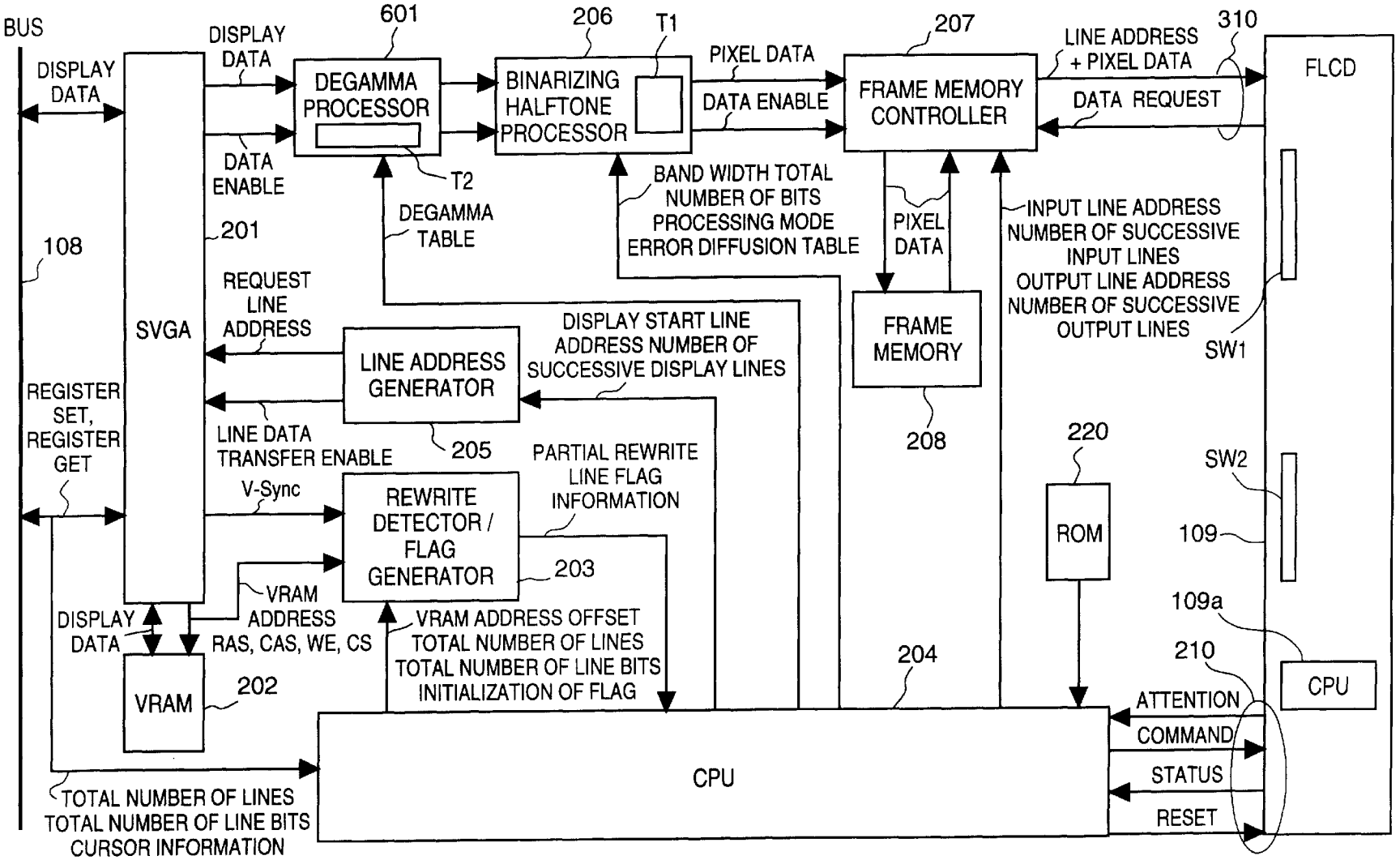
FIG. 12 is a block diagram showing the arrangement of an image supply device (FLCD-I/F) according to the third embodiment of the present invention.

The configuration of the FLCD-I/F 110 in the third embodiment (FIG. 12) is nearly identical with the configuration of the FLCD-I/F 110 in the second embodiment (FIG. 6) and the same reference numerals as in FIG. 6 denote the same components in FIG. 12.

An FLCD 109 is equipped with two slide switches SW1 and SW2. The slide switch SW1 is used to change the error diffusion tables T1, and the slide switch SW2 is used to change the degamma tables T2.

A CPU 109*a* of the FLCD 109 transmits an attention corresponding to an operated one of the slide switches SW1 and SW2 to the FLCD-I/F 110. A CPU 204 of the FLCD-I/F 110 determines the type of the received attention and performs an operation corresponding to the attention type. That is, when the slide switch SW1 for changing the error diffusion tables T1 is operated, the CPU 204 performs the same operation as in the first embodiment illustrated in FIG. 4. When the slide switch SW2 for changing the degamma tables T2 is operated, the CPU 204 performs the same operation as in the second embodiment shown in FIG. 8. This allows a user to smoothly perform fine image adjustment in real time while the user is monitoring a change on the display screen.

The present invention is not restricted to the above embodiments, and it is possible to add a change of another image processing (generation) parameter. That is, processing for changing another image processing (generation) parameter can be easily added by performing communications between the display device (FLCD 109) and the image supply device (FLCD-I/F 110) by serial communications.

Also, communications between the display device and the image supply device can be accomplished by parallel communications using a plurality of signal lines. Furthermore, a dial switch or the like, other than the slide switch, can also be used as the input means for inputting the image adjustment instruction signal.

As has been described in detail above, according to the first to third embodiments of the present invention, a user can smoothly perform fine image adjustment while monitoring a display screen in a display control system which includes an image supply device for supplying image information while performing image processing and an image display device for displaying the image information supplied from the image supply device.

Fourth Embodiment

An overall operation of the apparatus of the present invention will be described below. Note that this fourth embodiment makes use of the FLCD-I/F 110 of the second embodiment described previously.

That is, an FLCD-I/F 110 in the fourth embodiment has the same configuration as that shown in FIG. 6.

This FLCD-I/F 110 can be either fixed to the system or connected as a card (or a board) to a portion called an extended slot of an information processing apparatus represented by a workstation or a personal computer. That is, an FLCD 109 and its interface 110 of this embodiment can be incorporated in any form into the system or connected to the system as a separate external unit. If the FLCD 109 is an external unit separated from the information processing apparatus, the FLCD 109 is connected to the FLCD-I/F 110 through a cable.

In either case, in this system an OS or an application is loaded from a storage unit 106 or 107 into a main memory 111 and executed. Display information during the execution is stored in an internal VRAM of the FLCD-I/F 110 and displayed on the FLCD 109. Note that any OS or application can be executed. Examples are MS-WINDOWS available from Microsoft, as an OS and applications operating on this OS.

Also, as explained previously, when the FLCD-I/F 110 is connected to a personal computer or the like, it is necessary to write images into the internal VRAM of the FLCD-I/F 110. This processing is performed by installing a dedicated device driver (a kind of software) for the FLCD stored in the storage unit 106.

Figure 13:
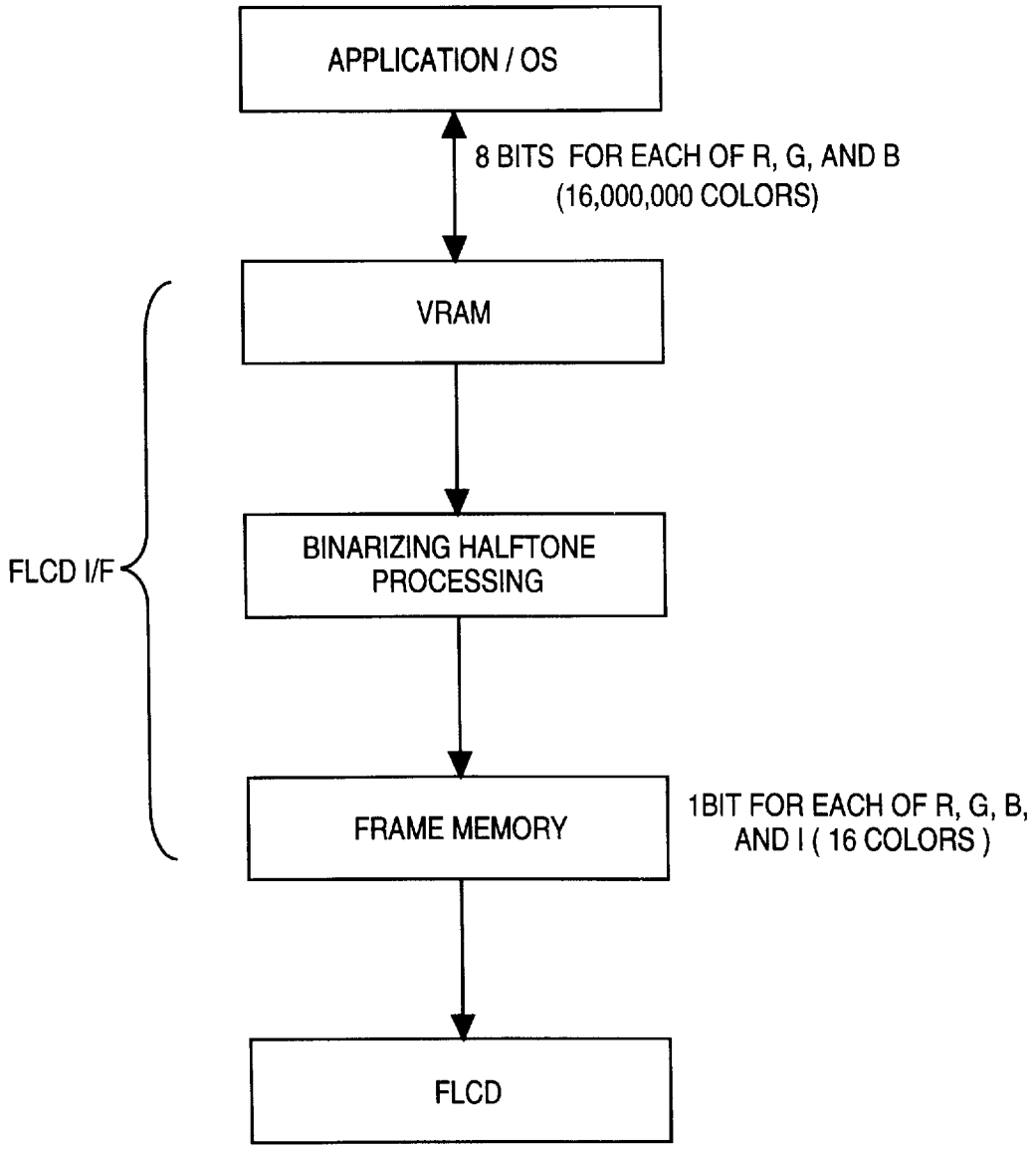
FIG. 13 is a view showing the flow of data related to image display in the embodiment.

FIG. 13 shows the concept of the flow of data concerning image display in the system of this embodiment.

When an application or an OS writes data into the internal VRAM of the FLCD-I/F 110, this data is subjected to binarizing halftone processing (in this embodiment ED processing) and written into a frame memory 208 (four bits per pixel=R, G, B, I) of the FLCD 109, which has a capacity of one frame. That is, in a common display device, the contents of a VRAM are directly transferred to the display device. However, in the FLCD-I/F 110 of this embodiment, the frame memory 208 is interposed between the VRAM and the FLCD 109 as a display.

A detailed block configuration of the FLCD-I/F 110 of this fourth embodiment is as illustrated in FIG. 6.

A CPU 204 is provided in the FLCD-I/F 110 and controls the entire interface. This CPU 204 operates in accordance with programs stored in a ROM 220.

In a VRAM 202, one byte (eight bits) of each of R, G, and B is assigned to one pixel (a total of 3 bytes=24 bits= approximately 16,000,000 colors). Generally, when eight bits are given to each of R, G and B, a color image reproduced in this way is called a full-color image. In this embodiment, the VRAM 202 has a capacity of capable of storing an image of a size of 1280×1024 dots (1280×1024×3 ≅4M-bytes).

An SVGA 201 is a chip for controlling an access to the VRAM 202. The SVGA 201 can draw (write) images into and reads out images from the VRAM 202 on the basis of an instruction from a CPU 101 of the information processing system. The SVGA 201 also has a function of drawing graphic patterns on the basis of an instruction from the CPU 101 and has other functions (to be described later). Note that an LSI for drawing various graphic patterns in the VRAM 202 is widely used as a display control chip and is well known to those skilled in the art.

When the SVGA chip 201 performs a write (drawing) to the VRAM 202, a write detector/flag generator 203 triggers a write enable signal (which actually includes a chip select signal) and detects the write address, thereby detecting the updated line and holding it.

More specifically, this write detector/flag generator 203 uses the write enable signal when the SVGA chip 201 performs write access to the VRAM 202, and latches the output address in a register (not shown). From this latched data, the write detector/flag generator 203 calculates the line on the display screen to which the write is done (this calculation can be accomplished by a circuit which divides a write address by the number of bytes of one line), and sets "1" in an area flag corresponding to the rewritten line. In this embodiment, the number of lines on the whole screen of the FLCD 109 is 1024 (0th to 1023rd lines), and areas are provided in units of 32 lines. Therefore, the area flag has a total of 32 (=1024/32) bits. That is, individual bits of these 32-bit flags hold information indicating whether a write is performed in areas of 0th to 31st lines, 32nd to 63rd lines, . . . , and 992nd to 1023rd lines.

The information indicating whether a rewrite operation is done is held in units of a certain number of lines, rather than for each line, since in changing a display image, a rewrite operation is usually performed across a plurality of lines, i.e., a rewrite operation is hardly done for each line. Note that the number of lines assigned to one area is not limited to 32, so any other numbers are usable. However, the number of bits of the area flag is increased if the number of lines is too small. Also, the number of instructions for partial rewrite processing (to be described later) is increased accordingly, and this increases the possibility of overhead. On the other hand, if the number of lines to be assigned is too large, redundant partial rewrite processing may increase. For these reasons, the number of lines to be assigned to one area is 32 in this embodiment.

Although an explanation will be given later, the maximum number of dots that can be displayed by the FLCD 109 is 1280×1024. However, to be able to display some other number of dots (e.g., 1024×768, 600×480), an information amount of one line used in calculations of rewrite lines is programmable. The number of display dots is changed on the basis of an instruction from the CPU 101 of the information processing apparatus (the program operating at that time is a control driver of the FLCD-I/F in this embodiment).

When detecting that a rewrite is done for areas in units of 32 lines written in the VRAM 202, the rewrite detector/flag generator 203 informs the CPU 204 of the contents of the area flag. Also, as will be described later, the rewrite detector/flag generator 203 clears the area flag to zero in accordance with a request from the CPU 204.

A line address generator 205 receives the first address of a line designated by the CPU 204 and the number of offset lines from that line and outputs an address for data transfer and a control signal for the transfer to the SVGA chip 201. Upon receiving the address data and the signal, the SVGA chip 201 outputs image data (eight bits for each of R, G, and B) having the designated number of lines from the corresponding line to a degamma processor 601.

The degamma processor 601 is constituted by a lookup table, and the contents of the table are freely changeable on the basis of an instruction from the CPU 204. This is already described in the second embodiment. Although details of the function of the degamma processor 601 will be described later, the degamma processor 601 changes the contrast of a display image in accordance with the contents set by a contrast adjustment volume of the FLCD 109.

The degamma processor 601 outputs the corrected image data to a binarizing halftone processor 206.

The binarizing halftone processor 206 quantizes the image data (eight bits per pixel for each of R, G, and B), which is supplied from the SVGA chip 201 via the degamma processor 601, into R, G. B, and a luminance signal I (one bit each component, a total of four bits) on the basis of an error diffusion method. Note that the technique of binarizing from eight bits to one bit for each of R, G, and B and producing the binary signal I which indicates the value of luminance has already been proposed by the assignor of this application (e.g., Japanese Patent Application No. 4-126148). Note also that the binarizing halftone processor 206 incorporates a buffer memory required for the error diffusion processing in order to execute the processing.

The binarizing halftone processor 206 receives an error diffusion table (parameter) as a parameter for the binarization and the positions and numbers of lines to be output, on the basis of an instruction from the CPU 204, and outputs the corresponding data. The error diffusion tables are not fixed but can be dynamically set by the CPU 204 so as to be able to, e.g., change colors on the basis of an instruction from the CPU 101 of the information processing apparatus.

A frame memory 208 stores images (data containing one bit per pixel for each of R, G, G, and I) to be displayed on the FLCD 109. As described previously, the maximum display size of the FLCD 109 is 1280×1024 dots, and each dot consists of four bits. Accordingly, the frame memory 208 has a capacity of one Mbyte (640 kbytes on a calculation basis).

A frame memory controller 207 controls write/read access to the frame memory 208 and a transfer to the FLCD 109. More specifically, the frame memory controller 207 stores the output RGBI data from the binarizing halftone processor 206 into the frame memory and outputs an area designated by the CPU 204 to the FLCD 109 through a data transfer bus 310 (note that the data bus has 16 bits and can therefore transfer data of four pixels at once). Also, except when image data of a certain large number of lines is being transferred to the FLCD 109 (i.e., when transfer of image data instructed by the CPU 204 is completed and there is no next transfer instruction), if the frame memory controller 207 receives a data transfer request from the FLCD 109, the controller 207 informs the CPU 204 of the request as an interrupt signal. Note that a data format used in the transfer to the FLCD 109 has a set of a total of four bits of RGBI, and the data is also stored in this format in the frame memory 208.

Furthermore, when the frame memory controller 207 completely stores the image data from the binarizing halftone processor 206 into the frame memory, the controller 207 outputs an interrupt signal indicating the completion to the CPU 204. Also, when completing transfer of image data of a line designated by the CPU 204 (if transfer of a plurality of lines is designated, when completing transfer of image data of the designated number of lines), the frame memory controller 207 outputs an interrupt signal indicating the completion to the CPU 204.

An interrupt tc, the CPU 204 is generated in some other cases such as when data is received from a dedicated serial communication line (e.g., RS-232C) for communications with the FLCD 109. This will be described in detail later.

In the above arrangement, when the CPU 101 of the information processing apparatus main body receives a request of drawing characters or graphic patterns from an OS or an application, the CPU 101 outputs the corresponding command or image data to the SVGA chip 201 of the FLCD-I/F 110. When receiving the image data, the SVGA chip 201 writes the image in the designated position in the VRAM 202. When receiving the graphic data drawing command, the SVGA chip 201 draws the graphic image at the corresponding position in the VRAM 202. That is, SVGA chip 201 performs write processing to the VRAM 202.

As described earlier, the rewrite detector/flag generator 203 monitors a write action by the SVGA chip 201. Consequently, the rewrite detector/flag generator 203 sets a flag corresponding to the written area and informs the CPU 204 of the setting of the flag.

The CPU 204 reads out the area flag stored in the rewrite detector/flag generator 203 and resets the area flag to the rewrite detector/flag generator 203, thereby preparing for the next rewrite access. This reset operation can also be done by using a hardware means so that the reset is performed simultaneously with the read action.

The CPU 204 checks from the readout area flag which bit is set, i.e., to which area (areas in some instances) the rewrite is performed. To transfer the rewritten area to the VRAM 202, the degamma processor 601, and the binarizing halftone processor 206, the CPU 204 outputs, to the line address generator 205, the first address (usually the address at the left end of the screen) of the transfer start line and data indicating the number of lines of an image to be transferred from that position.

It should be noted that if the CPU 204 detects that a write is done in, e.g., the 10th area, i.e., an area from the 320th to 351st lines of the VRAM 202, the CPU 204 instructs the line address generator 205 to transfer 32 linesnot from the address at the first pixel in the 320th line but from the first pixel address in a line (315th line) five lines before the 320th line. That is, the CPU 204 instructs the line address generator 205 to transfer lines from the 315th to 351st lines. This reason is as follows.

General error diffusion processing uses a two-dimensional matrix having weighting element values (values indicating the ratio of distribution) in order to diffuse a produced error into unprocessed pixels. The produced error sequentially propagates into these pixels. Assuming two pixels A and B, consider an influence of an error occurring upon binarization at the position of the pixel A on the position of the pixel B (unprocessed pixel). In this case, the influence of the error in the pixel A on the pixel B decreases as the distance between the two pixels A and B increases. In other words, if the distance is considerably large, the influence of the error at the pixel A on the pixel B is negligibly small. The margin of five lines described above is based on this reason. Note the distance by which the influence of the error is negligible depends upon the size and the weighting element values of the error diffusion matrix. Also, it will be understood from the above explanation that the direction of the error diffusion processing by the binarizing halftone processor 206 in this embodiment is from the upper left corner to the lower right corner of an image.

The CPU 204 also instructs the binarizing halftone processor 206 to indicate which part of the line data as a result of the binarizing halftone processing is to be output.

That is, as described previously, when a write operation is performed in an area from the 320th to 351st lines of the VRAM 202, data from the 315th to 351st lines is transferred to the binarizing halftone processor 206 via the degamma processor. However, the CPU 204 instructs the binarizing halftone processor 206 to output data from the 320th to 351st lines.

As a consequence, the binarizing halftone processor 206 outputs, to the frame memory controller 207, data from the 320th to 351st lines which is influenced by an image in an unchanged portion before the 319th line.

On the basis of an instruction from the CPU 204, the frame memory controller 207 writes the output data (four bits per pixel) in units of lines from the binarizing halftone processor 206 into the corresponding positions of the frame memory 208. That is, the CPU 204 has information indicating the number of output lines from the binarizing halftone processor and the line number of the first line in an image. Accordingly, the CPU 204 sets data indicating the address (the first write address to the frame memory 208) of input lines and the number of lines of data to be successively written.

Consequently, the frame memory 208 stores an image of only the rewritten portion (updated image) in which a portion connected to an image that is not rewritten is natural. The frame memory controller 207 generates the interrupt signal described above when completing the storage of the transferred data, corresponding to the area designated by the CPU 204, from the binarizing halftone processor 206 into the frame memory 208.

In this embodiment, the processing speed of the binarizing halftone processor 206 is presently about 1/30 sec for one frame. This is approximately a half speed with respect to about 60 Hz of a vertical sync signal of, e.g., a CRT. Fortunately, an entire frame is rarely rewritten as long as normal applications are used. In other words, the number of lines processed by the binarizing halftone processor 206 is not so large in practice, and so the processing amount is necessarily small. Therefore, a period until the completion of the processing in a whole frame is not much different from, or, if the area to be processed is smaller than a half frame, shorter than the display updating period of a CRT.

The frame memory controller 207 also receives an output instruction for the FLCD 109 from the CPU 204. This output instruction indicates what number of lines (successive lines) are to be transferred from which line (the first address of the lines). When this transfer is completed, the frame memory controller 207 generates an interrupt signal indicating the completion to the CPU 204 as described previously.

The data format which the frame memory controller 207 transfers to the FLCD 109 is as follows:

write line address+RGBI+RGBI+ . . . +RGBI

The FLCD 109 receives this data and uses data immediately succeeding the first address of the data to drive the FLCD 109.

Note that the binarizing halftone processor 206 sometimes outputs a write processing result of a plurality of discontinuous areas. Also, an instruction of transfer to the FLCD 109 is issued to the frame memory controller 207 after the completion of the preceding transfer to the FLCD 109 is informed. Accordingly, image data written in the frame memory 208 is not necessarily immediately output to the FLCD 109. That is, by performing processing using the frame memory 208 as described above, the write access to the VRAM 202 and the output to the FLCD 109 are entirely asynchronously processed.

Figure 14:
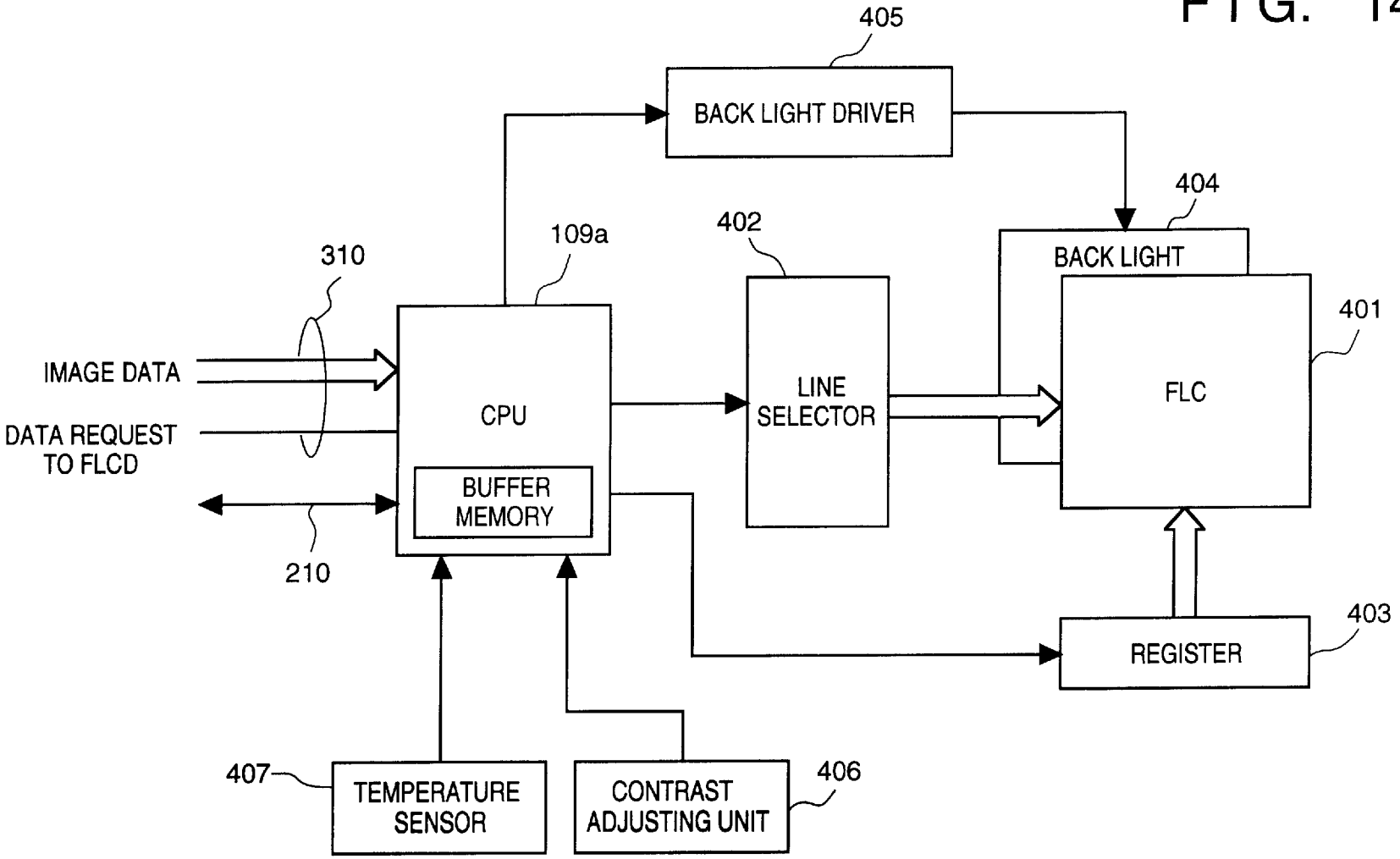
FIG. 14 is a block diagram of an FLCD in the fourth embodiment.

FIG. 14 is a block diagram of the FLCD 109 in this embodiment. In FIG. 14, reference numeral 109*a* denotes a CPU for controlling the whole FLCD; 401, an FLC panel; 402, a circuit for selecting one of lines of the FLC panel 401; 403, a register having a capacity for storing one line; 404, a back light for the FLC panel 401; 405, a back light driver for driving the back light; 406, a contrast adjusting unit by which a user can freely adjust the contrast of the screen; and 407, a temperature sensor for sensing the temperature of the FLC 401.

The CPU 109*a* receives the data with the format write line address+RGBI+RGBI . . .

described above from the FLCD-I/F 110 through the data transfer bus 310 and checks the first write address. Also, the CPU 109*a* supplies pixel data RGBIRGBI . . . received after the above data to the register 403. The CPU 109*a* then instructs the line selector 402 to select a line indicated by the write address to thereby update the display of the FLC. The CPU 109*a* also generates a data transfer request signal to the FLCD-I/F 110 whenever one line is displayed at a time interval (varying from 60 to 70 μsec) which depends on the temperature sensed by the temperature sensor 407. The result of adjustment by the contrast adjusting unit 406 is transferred to the FLCD-I/F 110 through the serial communication line 210. Details of this communication will be described later.

When requested to transfer 32 lines by the CPU 204, the frame memory controller 207 outputs data in units of lines in accordance with the format described above each time the controller 207 receives this data transfer request from the FLCD 109. After the transfer of all the designated lines is completed, if the frame memory controller 207 does not receive the next transfer request and has received the data transfer request signal from the FLCD 109, the frame memory controller 207 informs the CPU 204 of this information as an interrupt signal.

Upon receiving this information (interrupt), the CPU 204 checks whether untransferred data of a partially rewritten image is present. If no such data is present, the CPU 204 instructs the frame memory controller 207 to transfer image data of all frames stored in the frame memory 208 to the FLCD 109 in an interlaced manner. That is, whenever receiving this interrupt signal, the CPU 204 instructs the frame memory controller 207 to transfer image data in units of lines in the order of first line, third line, . . . , 1023rd line, second line, . . . , 1024th line. In effect, if the transfer request signal comes from the FLCD 109, the CPU 204 designates a line to be transferred when the next transfer request signal comes.

When an image does not vary, an interlaced transfer is performed as described above for the reason to be explained below.

As described previously, the FLCD 109 used in this embodiment has a function of storing and holding display images, so theoretically it is only necessary to transfer an image of only a changed portion. However, it turns out that a small difference occurs in the luminance in the boundary between an image which is not at all changed and need not be refreshed and an image which is changed and newly displayed (partially rewritten).

More specifically, when the display image is partially updated, the FLCD 109 of this embodiment updates its display only in this updated portion. However, if there is no change in the display image, all images in the frame memory 208 are transferred to the FLCD 109 in an interlaced manner. In this case, the lines are transferred not in sequence but in an interlaced manner to raise the speed of an apparent updating of the display image, since the response of a liquid crystal display is not generally rapid.

In accordance with the processing contents described above, the operation procedure of the CPU 204 of the FLCD-I/F 110 will be described below with reference to FIG. 15.

Figure 15:
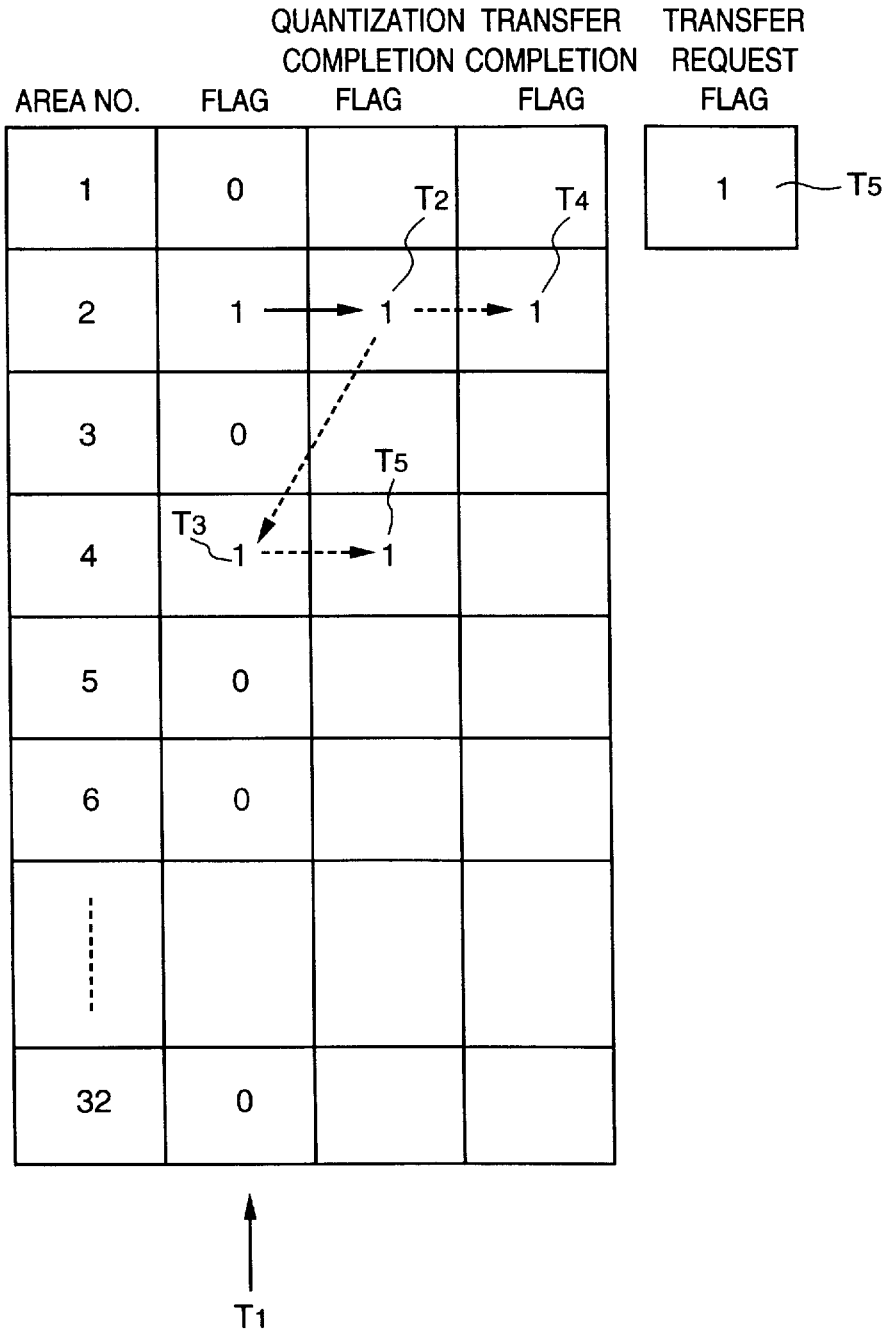
FIG. 15 is a view showing the transitions of flags while a CPU in an FLCD interface is in operation in the fourth embodiment.

The meanings of the individual flags shown in FIG. 15 are as follows.

A) Quantization completion flag:

A flag holding information indicating whether the frame memory controller 207 completely stores output image data from the binarizing halftone processor 206 into the frame memory 208.

B) Transfer completion flag:

A flag holding information indicating whether the frame memory controller 207 completely transfers an image at a position designated by the CPU 204 to the FLCD 109.

C) Transfer request flag:

A flag holding information indicating whether the FLCD 109 issues the next data transfer request. Note that this transfer request flag is not set unless the frame memory controller 207 has completed transfer of the number of lines designated by the CPU 204 (because the transfer request signal before the completion is used as a transfer timing of the frame memory controller 207, so no interrupt signal to the CPU 204 is generated with respect to the transfer request signal).

Assume that an area flag (32 bits) read out from the rewrite detector/flag generator 203 is as shown in FIG. 15 (timing T1).

If this is the case, the CPU 204 checks from the first flag and detects area position (to be referred to as area No. hereinafter) "2" in which "1" is set for the first time. In accordance with this detection, the CPU 204 calculates the address and the number of lines to be set in the frame memory controller 207, the binarizing halftone processor 206, and the line address generator 205, and sets the data in these circuits in the order named. The data is first set in the frame memory controller 207 because the controller 207 performs the operation when the enable signal (see FIG. 6) of each circuit is enabled. If the order is reversed, the high-order circuit outputs data although the low-order circuit has not been prepared.

When the address and the number of lines are finally set in the line address generator 205, this triggers the SVGA chip 201 to set the enable signals to the degamma processor 601 and the low-order binarizing halftone processor 206, thereby starting data transfer.

Consequently, the binarizing halftone processor 206 generates image data consisting of four bits for each of RGBI by the error diffusion processing on the basis of eight bits for each of R, G, and B. The binarizing halftone processor 206 does not output the processing result by setting the enable signal to the low-order frame memory controller 207 unless the line (fifth line) set by the CPU 204 is reached. That is, lines before the fifth line are discarded for the reason explained earlier.

The frame memory controller 207 sequentially stores the input processed image data from the binarizing halftone processor 206 in the address positions of the frame memory 208 which are designated by the CPU 204. When completing the storage of the data of the designated number of lines, the frame memory controller 207 outputs an interrupt signal indicating the storage completion to the CPU 204.

Upon receiving this interrupt signal, the CPU 204 sets the quantization completion flag (timing T2) and instructs the frame memory controller 207 to transfer the data to the FLCD 109 (sets the address and the line number). Also, the CPU 204 checks whether there is a set area No. other than area No. "2" in the area flag. If any, the CPU 204 performs the same processing as above for that area. In the case of FIG. 15, write access to area No. "4" is also confirmed. Therefore, the CPU 204 performs the processing up to the storage into the frame memory 208 for that area too. When this storage is completed (timing T3), the CPU 204 performs the same processing for subsequent set area Nos. in the area flag.

In the course of the processing, if the CPU 204 receives an interrupt signal indicating the completion of transfer of area No. "2", whose transfer is previously instructed, from the frame memory controller 207, the CPU 204 sets the transfer completion flag with respect to area No. "2" to 1 (timing T4). The CPU 204 also checks whether there is another area No. in which the quantization completion flag is "1", and, if any, instructs transfer of that area to the FLCD 109.

Note that which of timing T4 and timing T3 occurs earlier is indefinite since it depends on the data amount to be processed.

When the transfer completion information is issued and there is no data to be transferred next, the frame memory controller 207 outputs an interrupt signal based on the data transfer request signal from the FLCD 109 (timing T5). The CPU 204 receives this interrupt signal and reads out a new area flag from the rewrite detector/flag generator 203.

If there is no bit "1" in the readout area flag, the CPU 204 sets an address of one line to be transferred in order to perform interlaced transfer (interlaced transfer of every other line) to the frame memory 208, as described previously. When this transfer is completed, the frame memory controller 207 receives a data transfer request signal from the FLCD 109. Since, however, at this time the transfer of data of one line is completed, the frame memory controller 207 sends an interrupt to the CPU 204.

Whenever receiving this interrupt, the CPU 204 reads out an area flag from the rewrite detector/flag generator 203. However, while all bits are "0", the CPU 204 continues the interlaced transfer described above.

In short, when the area flag shown in FIG. 15 is read out and if it is found that there is even only one area No. in which "1" is set in the readout flag, each processing is performed as if the area flag is shifted right in the flag table of FIG. 15.

A series of steps processed by the CPU 204 in order to realize the above processing of this embodiment will be described below with reference to FIGS. 16 to 19. Note that programs based on these flow charts are stored in the ROM 220.

Figure 16:
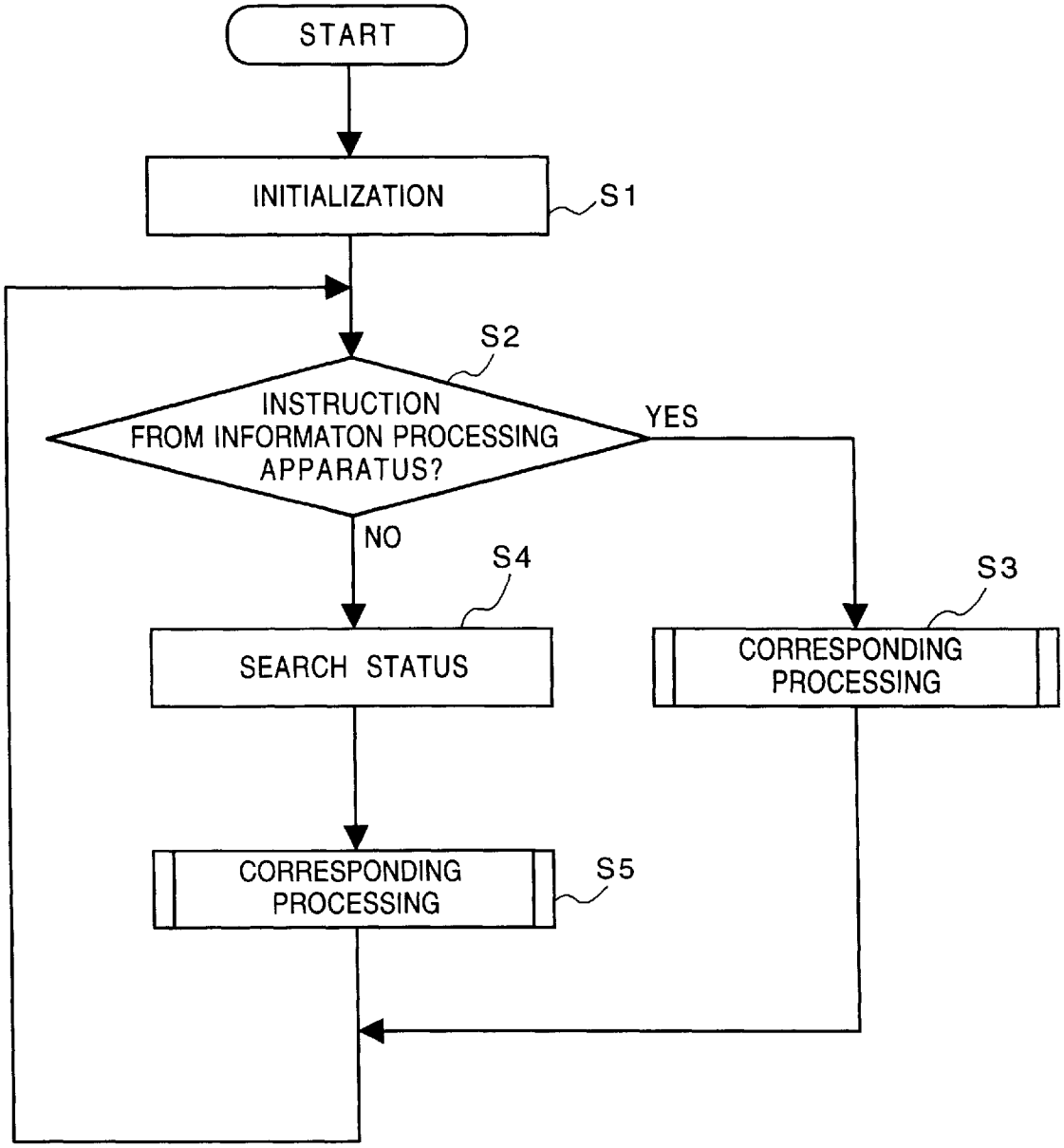
FIG. 16 is a flow chart showing the main processing routine of the CPU in the FLCD interface in the fourth embodiment.

FIG. 16 is a flow chart showing the main processing routine of the CPU 204 of the FLCD-I/F 110 in this embodiment.

When the power switch is turned on, the CPU 204 performs initialization, e.g., initializes the individual circuits of the FLCD-I/F 110 in step Si. At the same time, the CPU 204 issues a command such as Unit Start to the FLCD 109 and receives the response.

In step S2, the CPU 204 checks through the bus 108 of the information processing apparatus main body whether a state instruction pertaining to display, such as the number of display dots, is issued. If YES in step S2, the flow advances to step S3, and the CPU 204 performs the instructed processing, e.g., sets the number of display dots, as environmental information, in the circuits 205 to 207 and 601 including the rewrite detector/flag generator 203.

If the CPU 204 determines in step S2 that no instruction is issued from the information processing apparatus, the flow advances to step S4, and the CPU 204 searches the current status. The flow then advances to step S5, and the CPU 204 performs processing meeting the status.

As already described above, the FLCD 109 of this embodiment has a display capacity of 1280×1024 dots. If, for example, 1024×768 is designated by the information processing apparatus, an image is preferably displayed in the center of the display screen of the FLCD 109 since this gives the operator an impression of naturalness. The processing in step S3 is done to realize this display. As an example, to specify a rewritten line position, the rewrite detector/flag generator 203 divides the rewritten address by the number of bytes in one line. This number of bytes in one line is determined by the number of display dots.

Although details will be described later, it is necessary to force the FLCD 109 to perform a suitable operation. For this purpose, a command indicating this necessity is issued through the serial communication line 210 to make the operations of the FLCD 109 and the FLCD-I/F consistent.

In the following description, assume that a display of 1280×1024 dots is instructed.

Figure 17:
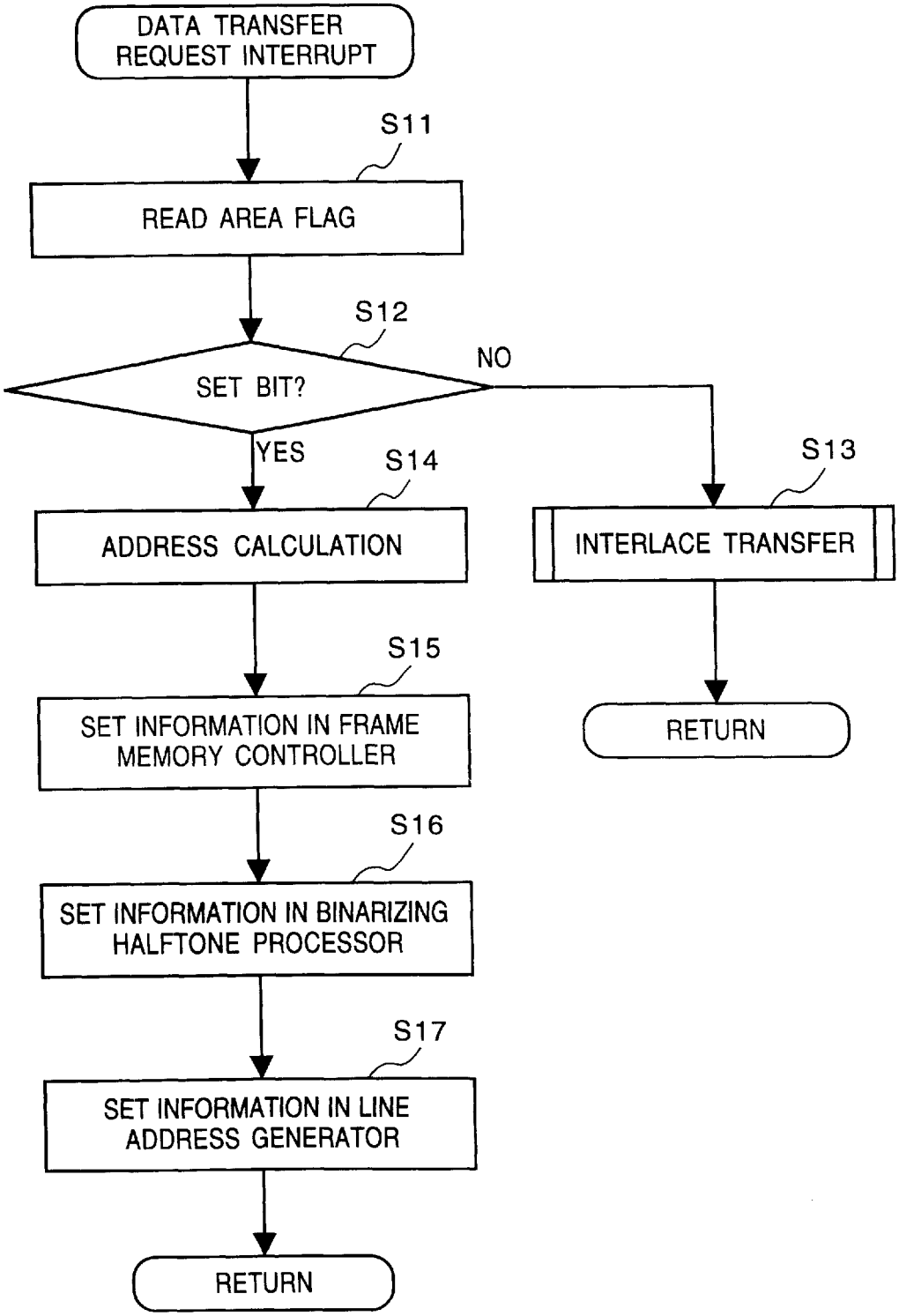
FIG. 17 is a flow chart showing an interrupt routine started upon reception of a data transfer request signal from a frame memory controller.

FIG. 17 is a flow chart of an interrupt routine activated when a data transfer request signal is received from the frame memory controller 207.

When instructed by the CPU 204 to transfer an image of the designated number of lines to the FLCD 109, the frame memory controller 207 performs the transfer in synchronism with the data transfer request signal from the FLCD 109. This is already described above. If no instruction comes from the CPU 204 or if the instructed transfer is completed and the data transfer request signal is received from the FLCD 109, the frame memory controller 207 directly outputs this signal as an interrupt signal to the CPU 204. In other words, when the frame memory controller 207 receives a series of transfer requests and receives a data transfer request from the FLCD 109 during the transfer, the frame memory controller 207 does not output any interrupt signal to the CPU 204.

The flow chart in FIG. 17 shows processing performed when this interrupt signal is received, i.e., shows interrupt processing after transfer of data to be sent is completed.

In step S11, the CPU 204 reads out 32 bits of an area flag from the rewrite detector/flag generator 203 and resets the rewrite detector/flag generator 203 to clear the internal area flags to zero.

In step S12, the CPU 204 checks whether the readout area flag has a set bit, i.e., a rewritten portion. If the CPU 204 determines in step S12 that all bits are "0", the flow advances to step S13, and the CPU 204 performs interlaced transfer. That is, if the CPU 204 does not detect any write to the VRAM 202, the CPU 204 performs interlaced transfer (instructs interlaced transfer of data of one line from the frame memory 208) whenever receiving a data transfer request from the FLCD 109.

On the other hand, if the CPU 204 finds in step S12 that a set bit exists, the flow advances to step S14, and the CPU 204 calculates an address and the number of lines to be set in individual circuits. if bits corresponding to area Nos. "10" to "12" (areas from 289th to 384th lines) are set, the CPU 204 calculates an address and the number of lines by regarding these areas as a single area.

When completing this calculation, the CPU 204 sets the respective corresponding information in the frame memory controller 207, the binarizing halftone processor 206, and finally the line address generator 205, thereby starting binarizing halftone processing (quantization) in steps S15 to S17. As described previously, the CPU 204 sets the address five lines before the first line of the rewritten area in the line address generator 205. However, if area No. "1" is rewritten, there are no lines before that area. If this is the case, the address calculated from the area No. is directly used.

As a consequence, the first quantization processing when a set bit is present in the readout area flag is commenced.

Figure 18:
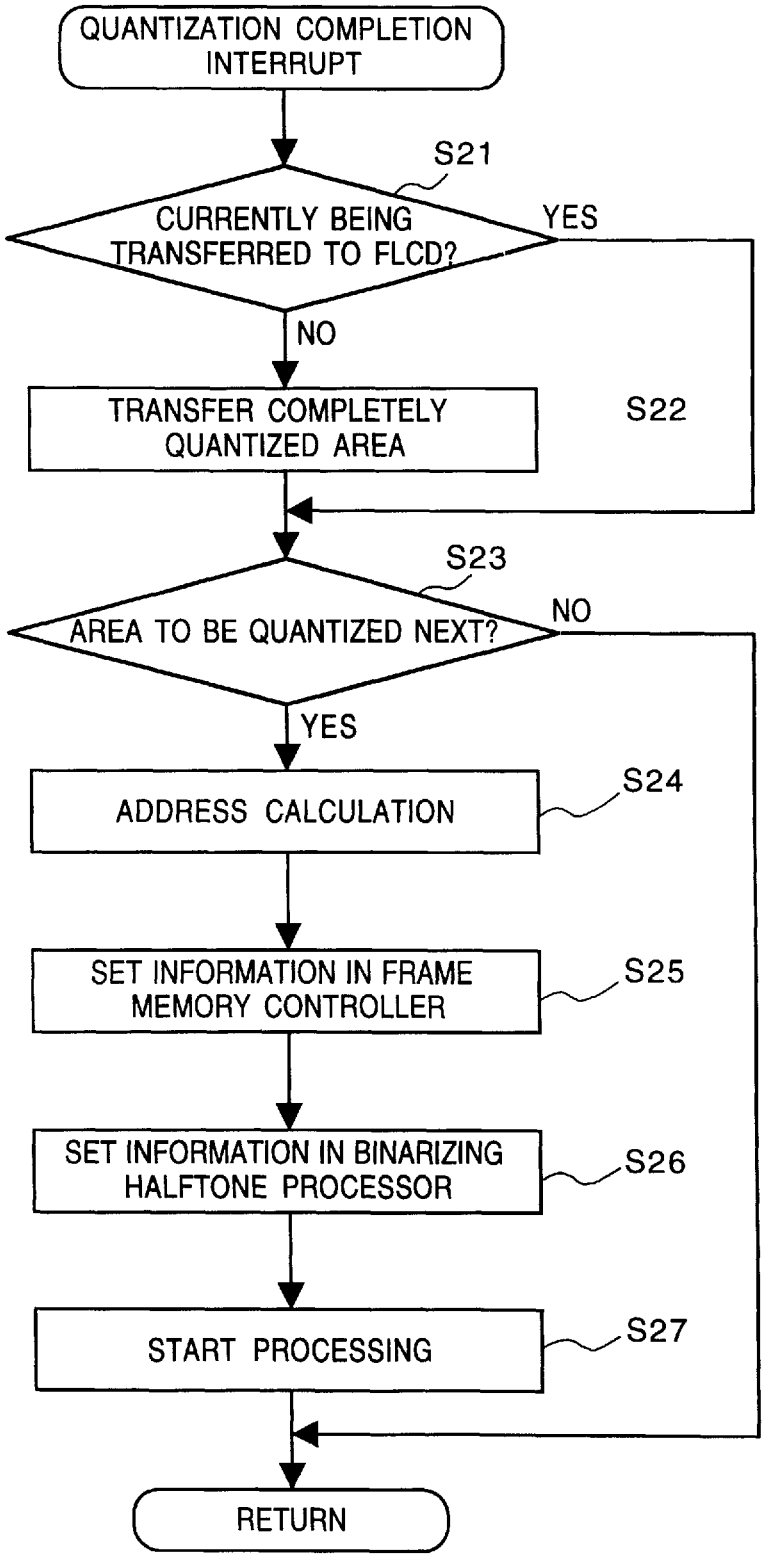
FIG. 18 is a flow chart showing processing started upon reception of quantization completion information from the frame memory controller.

FIG. 18 is a flow chart executed for an output interrupt signal from the frame memory 108 when the frame memory controller 207 receives the quantized image data from the binarizing halftone processor 206 and completes the storage of the data into the frame memory 208.

In step S21, the CPU 204 checks whether the frame memory controller 207 is currently transferring partially rewritten images to the FLCD 109.

If NO in step S21, i.e., if the CPU 204 determines in step S21 that interlaced transfer is presently being performed and the storage of the first partially rewritten image into the frame memory 208 is completed, the flow advances to step S22. In step S22, to cause the frame memory controller 207 to transfer the quantized image data which has just been stored, the CPU 204 sets the address and the number of lines of the data in the frame memory controller 207, thereby transferring the partially rewritten image.

In step S23, the CPU 204 determines whether there is an area to be quantized next by checking the already readout area flag.

If the CPU 204 determines in step S23 that there is an unquantized area, the CPU 204 calculates the address and the number of lines of that area in step S24. In steps S25 to S27, the CPU 204 sets the information in the individual circuits to cause the circuits to start the next quantization. Note that steps S24 to S27 are identical with steps S14 to S17 described above, so a detailed description thereof will be omitted.

Figure 19:
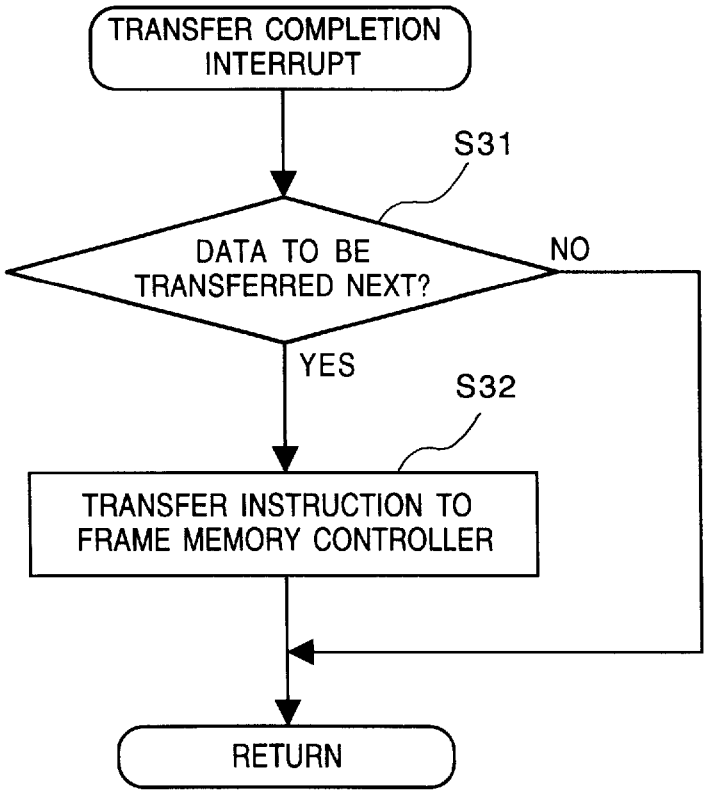
FIG. 19 is a flow chart showing processing started upon reception of transfer completion information from the frame memory controller to the FLCD.

FIG. 19 is a flow chart of interrupt processing when the frame memory controller 207 completes the transfer of the partially rewritten image designated by the CPU 204 to the FLCD 109.

In step S31, the CPU 204 checks whether there is data to be transferred next. If there is no data to be transferred, two cases are possible: images of all partially rewritten areas are completely transferred to the FLCD 109; and the quantization processing described above is not completed and the completion is being waited. In either case, the CPU 204 ends this processing if it determines that there is no data to be transferred.

On the other hand, if the CPU 204 determines that there is data to be transferred, the flow advances to step S32. In step S32, to cause the frame memory controller 207 to transfer the area to the FLCD 109, the CPU 204 sets the transfer start line address and the number of lines of that area in the frame memory controller 207, thereby starting the transfer.

As described above, by performing the above processing the CPU 204 can update the display of a partially rewritten portion and can perform interlaced display if there is no change. Although the core of these process procedures is, of course, the CPU 204, the processes largely depend on the frame memory controller 207, i.e., the influence of the frame memory 208 is remarkable as described above.

In this embodiment, writes to the VRAM 202 and updating of the display of the FLCD 109 can be performed entirely asynchronously. Consequently, it is possible to display images by fully utilizing the characteristic features of the FLCD 109.

Note that in this embodiment, when the CPU 204 issues a partial rewrite transfer instruction, the frame memory controller 207 does not output, to the CPU 204, an interrupt signal based on a data transfer request signal from the FLCD 109 while the partially rewritten images are being transferred. However, it is also possible to output an interrupt signal regardless of the state of the operation.

That is, the CPU 204 has information indicating the number of lines to be transferred when it issues a partial rewrite instruction. Accordingly, whenever the CPU 204 receives an interrupt signal, the CPU 204 can determine, by performing count-down and checking the value, whether the interrupt results from transfer completion or is output during interlaced transfer.

Note also that the process procedures of the CPU 204 in this embodiment are merely examples, so the present invention is not limited by these procedures. The point is, as described previously, that it is only necessary to transfer partially rewritten images to the FLCD 109 in an asynchronous manner by using the frame memory 208.

Communication done between the FLCD-I/F 110 and the FLCD 109 through the serial communication line 210 in this embodiment will be described below.

It will become evident from the following description that the FLCD 109 can be used in an optimum state by this communication. As an example, even if the FLCD 109 is turned on after the information processing system is turned on, the following communication eliminates the inconvenience that an image is not displayed on a full screen because only a partially rewritten image is transferred.

In principle, the communication in this embodiment uses data in units of bytes, since this reduces the data transfer and reception amounts for the both controllers (the CPU 204 and the CPU 109a) to thereby simplify the control.

Also, there are two types of codes, i.e., codes from the FLCD-I/F 110 (the CPU 204) to the FLCD 109, and codes from the FLCD 109 (the CPU 109*a*) to the FLCD-I/F 110. To avoid confusion, the former code (FLCD-I/F 110_FLCD 109) will be referred to as a "command" or a "command code", and the latter code (FLCD 109_FLCD-I/F 110) will be referred to as a "status" or a "status code", or as an "attention" or an "attention code". The difference between a status and an attention is that the former (status) is the response to a command and the latter (attention) is spontaneously generated by the FLCD 109.

Although the description lacks sequence, assume that the serial communication line 220 is not a single line, i.e., the line 220 is a RS-232C cable capable of full-duplex communication, and the number of lines is based upon the serial interface (cross interface). Also, the data transfer bus 310 includes the data bus and the data transfer request line described previously. In addition to these lines, the data transfer bus 310 includes a signal line for transmitting one logical level signal which, when the power supply (the power supply of the information processing apparatus) of the FLCD-I/F 110 is turned on, informs the FLCD 109 of ON of the power supply. In addition to this signal, the data transfer bus 310 of course includes predetermined signals such as a transfer clock.

Communication through the serial communication line 210 is done under the conditions of 9600 bps, a data bit length of 8 bits, and even parity. Note, however, that these conditions are not inherent in the present invention but are normally used in common serial communications, so a detailed description thereof will be omitted.

FIG. 20 shows details of commands in this embodiment, and statuses as the responses from the FLCD 109 to these commands. In FIG. 20, in column "CODE" in one major item "COMMAND", "H" indicates a hexadecimal number, and "x" indicates four variable bits. In the other major item "STATUS", "B" indicates a binary number, and "x" indicates one variable bit (it should be noted that "x" in a command indicates four bits). Individual commands will be described in the order shown in FIG. 20.

Request Unit ID: 00H

This command is for inquiring the type of FLCD connected.

Status:

When receiving this command, the FLCD 109 adds ID information stored in a ROM (not shown) of the CPU 109*a* and sends the status in the form of 00xxxxxxB to the FLCD-I/F 110 (in the normal case).

The six lower bits include a bit indicating whether the FLCD 109 performs a color display or a monochromatic display and a bit indicative of the screen size (the maximum number of dots that can be displayed). That is, by issuing this command "00H", the FLCD-I/F 110 can check what kind of an FLCD is connected.

As described previously, however, the FLCD-I/F 110 cannot normally send a command to the FLCD 109 in some cases under the influence of, e.g., noise. To meet this situation, in the case of error, the FLCD 109 sends back a status beginning with two upper bits "01", as shown in FIG. 20. Since this status in the error case is common to all commands, this error status for a received command will be described below.

The six lower bits of the error status consist of four type data bits indicative of the type of error and two content data bits indicative of the contents of the error. The type data and the content data are as follows.

Type data: Send Diagnostic error

Content data: This is an error corresponding to "Send Diagnostic (self-diagnostic result)" (to be described later). This error includes a check sum error of the ROM in the CPU 109*a*, an error (a verify error in write and read) of the RAM used as a work memory, and an error in some other display operation.

Type data: Reception error

Content data: This is an error during reception, such as a parity error, an overrun, or an out-of-definition command.

Type data: Send Host ID error

Content data: This is an error indicating that, when a "Send Host ID" command (to be described later) is received, it is determined that the Host (the FLCD-I/F 110) is an out-of-definition ID.

Type data: Set Mode error

Content data: This is an error for "Set Mode" (to be described later) and indicates transition disable (being disable to transit to a designated mode), i.e., indicates that an out-of-definition operation Mode is performed.

Type data: Read/Write error

Content data: This is an error for a "Read/Write" command (to be described later) and indicates write access to a Read Only area and an access to a Hidden area, and an undefined Address.

Type data: Set Address error

Content data: This error corresponds to a "Set Address" command (to be described later) and indicates that an out-of-range address is set.

Type data: Unit Start error

Content data: This error corresponds to a "Unit Start" command (to be described later) and indicates a state in which Start is still impossible, an Error state, or a state in which Start is already done.

Type data: Request Attention error

Content data: This error corresponds to a "Request Attention" command (to be described later) and indicates that there is no attention to be transmitted.

Type data: Request Status error

Content data: This error corresponds to a "Request Status" command (to be described later) and indicates that there is no status to be transmitted.

The foregoing is the error status, but the type data and the content data described above are merely examples. For example, since the type data is 4-bit data, it is possible to define 16 different type data in principle. Also, the status which the FLCD 109 sends when an error occurs in a received command is common to all commands as described previously, a description of the error status for commands described below will be omitted.

Request 1H: 01H

As described above, the FLCD 109 changes its operating speed (an image display period for one scan) in accordance with the temperature sensed by the temperature sensor 407. This command is for inquiring the current driving speed for one scan. As shown in FIG. 20, a status as the response from the FLCD 109 is data in which the six lower bits indicate the current one-scan driving period.

The FLCD-I/F 110 receives this status responding to the command issue and changes the skip intervals of interlace or the ratio of partial rewrite to updating of a full screen.

In the embodiments described previously, the FLCD 109 is caused to perform interlaced display when there is no data to be transferred to the FLCD 109. However, while, for example, a moving image is displayed in a predetermined area of the FLCD 109, an image only in this updated portion is updated. Accordingly, if the display time of this moving image is long, the difference occurs in the luminance between the unchanged portion and the changed portion, and this luminance difference is gradually emphasized.

While a partial rewrite is being continued, therefore, it is necessary to display a full-screen image at certain intervals. In this embodiment, a full-screen image is updated (full-image data in the frame memory 208 is transferred) within a period of a minimum of 1 Hz. This period of 1 Hz corresponds to the number of frames that can be displayed for one second. Since the driving period for one scanning line of the FLCD 109 depends on the temperature as described above, the meaning of this command will be understood.

This command also has an influence on the interlace intervals in interlaced display when there is no change on the screen. That is, when the temperature is not so high, the display speed of the FLCD 109 is necessarily lowered. In that case, an apparent updating rate of an entire image is raised by increasing the interlace intervals of interlace display. In contrast, the interlace intervals can naturally be small if the temperature is one at which a sufficient display speed is possible.

Unit Start: 02H

This command is for instructing the start of driving of the FLCD 109 connected. The FLCD 109 cannot display images unless it receives this command. Since the FLCD 109 need only send back a status indicating whether the operation is normally started, an attention in the normal state has no operand as shown in FIG. 20.

Request Attention inf.: 03H

When an attention is received from the FLCD 109, this command is used to request transmission of the detailed contents of the attention. Upon receiving this command, the FLCD 109 adds a code indicating the contents of the attention to the six lower bits and sends the resulting attention. As described earlier, "attention" means that the FLCD 109 does not output only a status as the response to the received command. That is, a code which the FLCD 109 "spontaneously" issues to the FLCD-I/F 110 is called an attention.

Request Attention Bit: 04H

This command is for requesting transmission of an attention status bit which the FLCD 109 has. The attention status of the FLCD 109 indicates, e.g., whether the FLCD 109 is Ready, 1H information is changed, the contrast is changed, or an error occurs. The FLCD 109 sends an attention in which data indicative of any of these contents is set in the six lower bits.

Get Mode: 05H

This is a command for requesting transmission of the current operating mode of the FLCD 109. The modes of the FLCD 109 include, e.g., a normal mode (a mode for performing the operations described previously), a static mode (a mode for freezing a display image by stopping reception of image data: this mode is suited to monitor still images), and a sleep mode (a mode for stopping display of images and driving of the back light: this mode is effective in saving power and prolonging the service lives of the back light and the FLCD). The FLCD 109 sends back data indicative of any of these modes as a status.

Request Status: 06H

When an error, e.g., a parity error, occurs in a status sent from the FLCD 109, this command is used to request retransmission of the attention. Upon receiving this command, the FLCD 109 again sends the status indicating the same contents as those previously sent.

Attention Clear: 0AH

This command is for clearing an attention from the FLCD 109. Since the FLCD 109 need only inform whether the attention is normally cleared, the FLCD 109 sends an attention in which all bits are "0" if it is normally cleared.

Get Contrast Enh.: 0BH

This command is for acquiring the state set by the contrast adjusting unit 406 of the FLCD 109. In accordance with the response (six bits in an attention) to this command, the degamma table contents of the degamma processor 601 described earlier are updated. Note that when the degamma tables are updated, the contrast of only a partially rewritten image is changed. Therefore, regarding that a write is done for an entire image in the VRAM 202, the CPU 204 of the FLCD-I/F 110 performs the binarization for the entire image and transfers the entire binarized image to the FLCD 109.

Get Multi: 0BH

The FLCD 109 of this embodiment has a function of displaying an image of n lines (at present n is one of 1, 2, and 4) from input image data of one line. Recently, although a demand has increasingly arisen for multimedia systems, a default number of display dots for moving images is at most about 300×200 dots, and the size is fixed depending on applications. Since in this case a display image is too small, two or four lines of the same image as a received original image of one line are displayed. This makes it possible to display an image much easier to see even if the original image is small. This also reduces the load on the FLCD-I/F 110 since it is not necessary for the FLCD 110 to transfer data of the same line a plurality of times. However, the frame memory controller 207 is so instructed as to transfer the same pixel n times in the main scanning direction. It is of course possible to independently designate the number of repetition times in the main scanning direction.

This Get Multi command is used to request transmission of the current state of the FLCD 109 (the current state is sent back by six bits of a status). This command is provided to prevent mismatching between the transmitter and the receiver of image data when the information processing system (e.g., a personal computer) is turned off and again turned on after n is set to "2" in the FLCD 109 by Set Multi command (to be described later).

Send Diagnostic: 1xH

This command is for causing the FLCD 109 to perform self-diagnosis and requesting transmission of the result. The diagnostic mode is designated in four bits represented by "x". The FLCD 109 sends back the diagnostic result corresponding to the designated one of several diagnostic modes.

Send Host ID: 2xH

This command is for informing the FLCD 109 of the ID (type) of the FLCD-I/F 110. Two of four bits in "x" indicate the version of the FLCD-I/F 110 and the two remaining bits indicate the ID (which is also the type of an information processing apparatus) of a card of the FLCD-I/F 110. When the FLCD 109 determines that the received ID is permissible, the FLCD 109 sends back a status in which all bits are "0".

Set Mode: 3xH

This command corresponds to the "Get Model" command and instructs the FLCD 109 to set any of the normal mode, the static mode, and the sleep mode. When the mode is normally set, the FLCD 109 sends back an attention in which all bits are "0". The issue timing of this command is, for example, when the user of the information processing apparatus intentionally instructs to set the mode and the information processing apparatus outputs this instruction. Also, the static mode is sometimes set when there is no change in an image even after a predetermined period (which is programmable by the user) elapses.

Set Multi: 4xH

This command corresponds to "Get Multi" described earlier and is used to display an image of one line as an image of one, two, or four lines. In a normal state an attention in which all bits are "0" is sent back. In this embodiment, when a so-called VGA mode of 640 dots (horizontal)×480 dots (vertical) is selected, this mode is detected to perform two-line simultaneous driving, thereby driving 1280×960 dots of the FLCD 109. However, it is also desirable to change the object of driving in accordance with the taste of a user. Therefore, various settings can also be performed using an environmental setting utility program of the FLCD-I/F 110 of the information processing apparatus.

The following commands, Write High/Low Memory commands (8xH, 9xH) and Read High/Low Memory commands (08H, 09H) are for writing or reading out data in or from an arbitrary address of the CPU 109*a* (address space= 64 K-bytes) of the FLCD 109. The four lower bits of each of the Write High/Low Memory commands indicate one byte of data to be written. Note that the Read High/Low Memory commands have, naturally, no operand (four variable bits).

In either case, it is necessary to designate a write address or a read address. This address is set by the four lower bits (a total of 16 bits) of each of Set HH/MH/ML/LL Address commands (Ax, Bx, Cs, DxH) shown in FIG. 20. From or into this address, data is to be read out or written. After the address is thus determined, a read or write operation is performed by a Read command or a Write command.

For the Read command, the four upper or lower bits of the byte of the designated address are returned as a status. For any other command, an attention in which all bits are "0" is returned if the command is normal.

Read or write accesses to the internal memory of the FLCD 109 are primarily used for debugging. However, by changing the work area in the FLCD 109, it is also possible in the future to handle situations that cannot be handled by the above commands alone. Furthermore, by storing the operation process programs of the CPU 109*a* of the FLCD 109 in a RAM, programs improved in performance can be stored in the RAM from the information processing apparatus.

The commands (command codes) sent from the FLCD-I/F 110 to the FLCD 109 and the response statuses are described above.

The case in which the FLCD 109 spontaneously sends an attention to the FLCD-I/F 110 will be described below.

The format of the spontaneous attention of the FLCD 109 is as follows:

10xxxxxxB

That is, the most significant bit (MSB) is "1".

The reason is that if the FLCD-I/F 110 sends a certain command to the FLCD 109 and at the same time the FLCD 109 spontaneously sends an attention to the FLCD-I/F 110, the FLCD-I/F 110 can determine that a spontaneous attention, rather than the response to the sent command, is received. That is, since in all of the response statuses to commands the MSB is "0" as described above, the FLCD-I/F 110 can readily determine the difference.

The six lower bits (bit 0 to bit 5) of the spontaneous attention from the FLCD 109 are as follows.

Bit 0: set when the FLCD 109 is READY.

Bit 1: set when the temperature sensor 407 senses the temperature and one scan driving period is changed accordingly.

Bit 2: set when the contrast adjusting unit 406 is operated.

Bit 3: undefined.

Bit 4: set when a recoverable error occurs in the FLCD 109.

Bit 5: set when an unrecoverable error occurs in the FLCD 109.

Examples of the recoverable error are the case in which no image data is supplied after a predetermined period elapses and the case in which an out-of-definition display mode is set. The unrecoverable error includes sensing disability caused by disconnection or a short circuit of the temperature sensor 407, sampling time-out, conversion end time-out, and data set time-out of the A/D converter caused by the temperature sensor 407, a ROM check error, and a RAM check error. Although the ROM check or the like processing is also performed by self-diagnosis in accordance with an instruction from the FLCD-I/F, the error herein mentioned is in an initialization check when the FLCD 109 is turned on.

If the FLCD 109 issues a spontaneous attention at the same time the FLCD-I/F 110 issues a command, i.e., if both of the FLCD 109 and the FLCD-I/F 110 send the first codes, the attention from the FLCD 109 is given priority in this embodiment. This is so because the request from the FLCD 109 is in the closest position in the image display, i.e., in the interface with the user.

Practical examples of communication steps using the above commands and attentions will be described below with reference to FIGS. 21 to 23.

Figure 21:
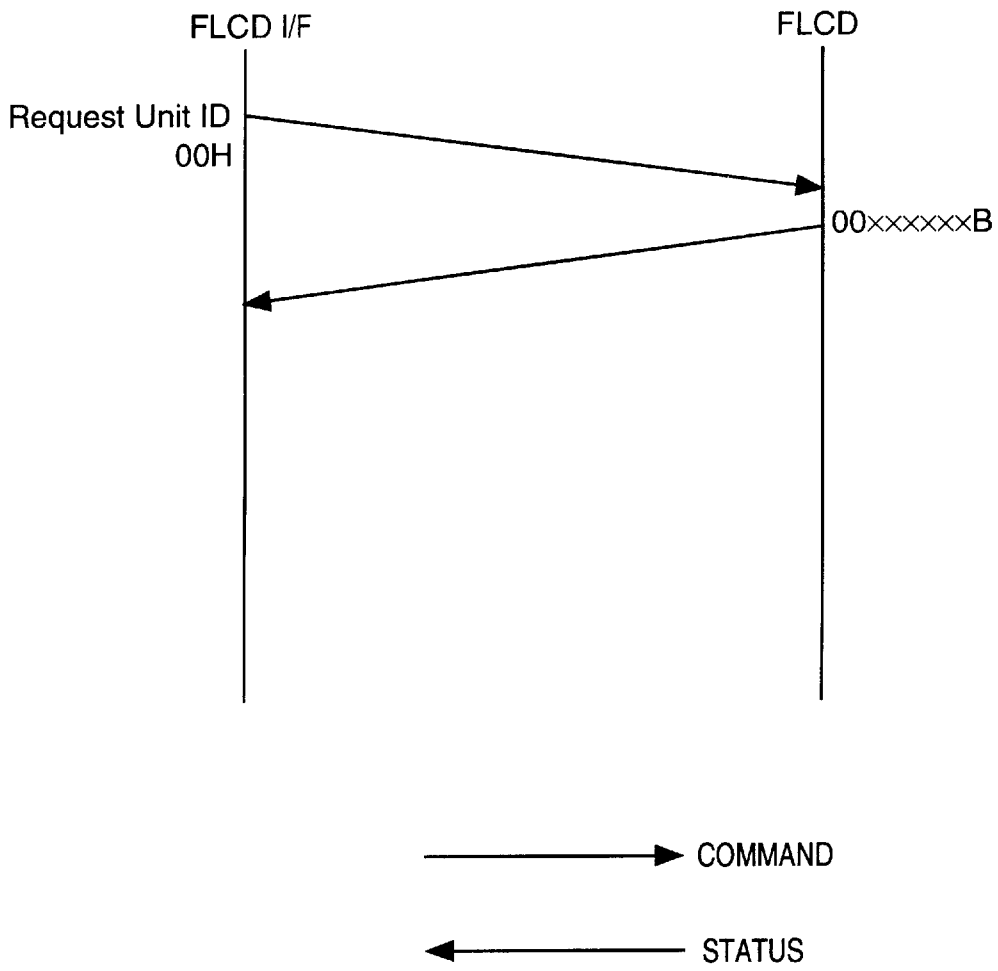
FIG. 21 is a view showing an example of a communication sequence between the FLCD interface and the FLCD in the fourth embodiment.

FIG. 21 shows a sequence in which the FLCD-I/F 110 acquires the ID of the FLCD 109.

First, the FLCD-I/F 110 (CPU 204) sends Request Unit ID (01H) to the FLCD 109 through the serial communication line 210. Upon receiving this command, the FLCD 109 (CPU 109*a*) reads out inherent information of the FLCD written in, e.g., an internal ROM (not shown) and sends back the readout information as a status to the FLCD-I/F 110.

In the above sequence, if a communication error (e.g., a parity error) occurs in the command issued from the FLCD-I/F 110, the FCLD 109 sends back an error status to inform that the reception is not normally done. When receiving this status, the FLCD-I/F 110 again issues the same command. If, on the other hand, a communication error takes place in the status from the FLCD 109, the FLCD-I/F 110 sends the Request Status command to request retransmission of the status.

Figure 22:
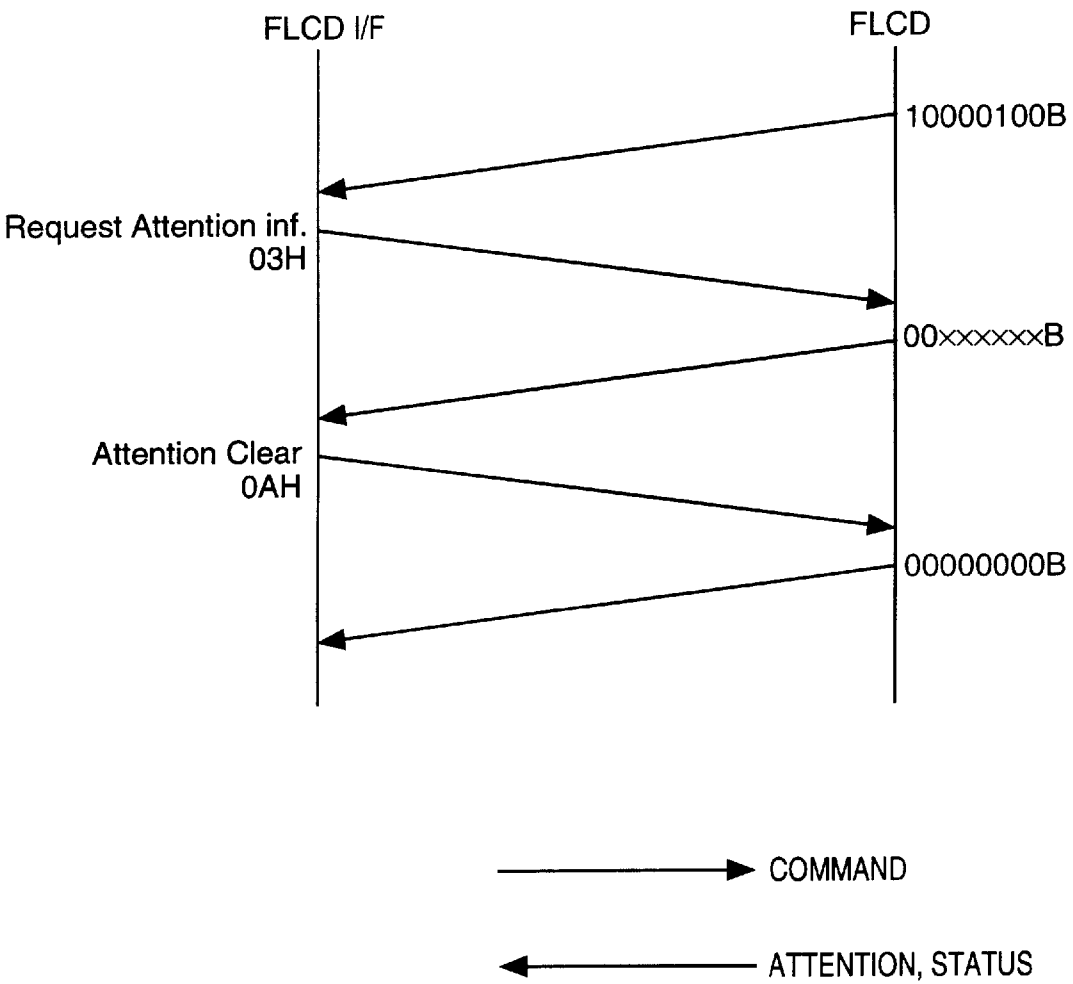
FIG. 22 is a view showing another example of the communication sequence between the FLCD interface and the FLCD in the fourth embodiment.

FIG. 22 shows a sequence when the FLCD 109 issues a spontaneous attention (in this case an attention issued when the contrast adjusting unit 406 changes the contrast).

First, the FLCD 109 transmits "10000100B", which is a spontaneous attention indicating occurrence of a contrast change, to the FLCD-I/F 110 through the serial communication line 210.

The FLCD-I/F 11C is informed of the contrast change by receiving this attention. Accordingly, the FLCD-I/F 110 sends the Request Attention inf. command (03H) for inquiring the contents of the change. Upon receiving the command, the FLCD 109 converts (by referring to a table (not shown)) data indicating the degree (to be referred to as a contrast value hereinafter) of the changed contrast into six bits and sends the converted data to the FLCD-I/F 110. The FLCD-I/F 110 receives this contrast value and rewrites the degamma table T2 in the degamma processor 601 by referring to the ROM 220. To end the processing for this spontaneous attention, the FLCD-I/F 110 issues the Attention Clear command. FLCD 109 is informed by this command that degamma conversion using this contrast value is completed or the conversion is to be surely performed. Therefore, the FLCD 109 sends an attention "00000000B" indicating that the information is received, thereby ending this processing.

Figure 23:
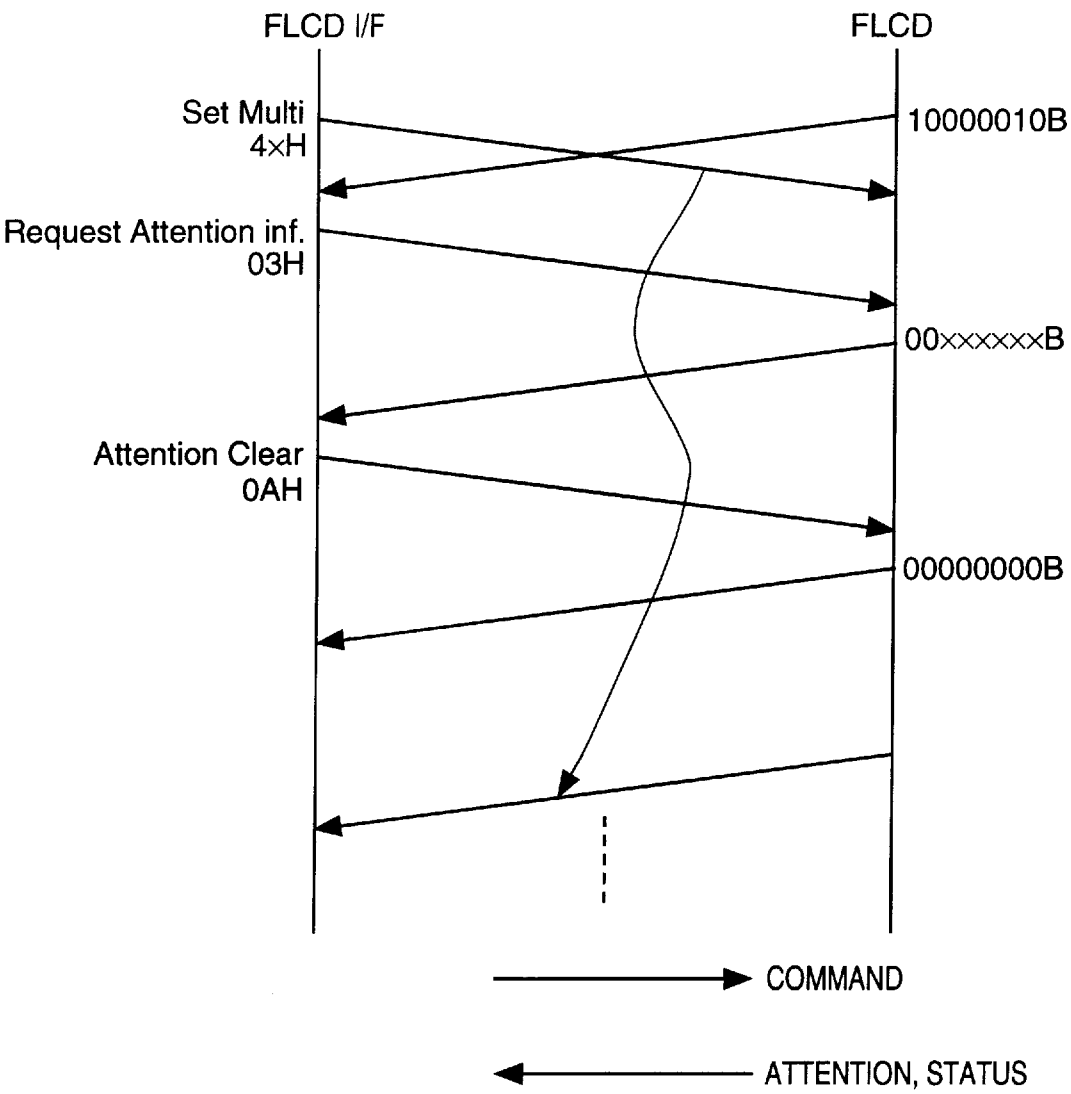
FIG. 23 is a view showing still another example of the communication sequence between the FLCD interface and the FLCD in the fourth embodiment.

FIG. 23 shows a sequence when the FLCD-I/F 110 issues a command (in this case the Set Multi command) and the FLCD 109 issues a spontaneous attention (in this case, an attention indicating that one scan driving period is changed by the temperature sensor 407) at the same time.

The FLCD-I/F 110 detects that the MSB of the received attention is "1" and thereby determines that the FLCD 109 has issued a spontaneous attention. Accordingly, the FLCD-I/F 110 postpones the processing for the Set Multi command transmitted previously. The FLCD-I/F 110 then issues the Request Status command to instruct transmission of the value of one scan driving period. Upon receiving the command, the FLCD 109 sets the value of one scan driving period, which is based on the current temperature value from the temperature sensor 407, in the six lower bits by referring to the table of the ROM (not shown), and transmits the data to the FLCD-I/F 110.

Upon receiving the data, the FLCD-I/F 110 changes its own operation contents as described above and also issues the Attention Clear command to the FLCD 109. By receiving "00000000B" from the FLCD 109, the FLCD-I/F 110 completes the processing for the spontaneous attention from the FLCD 109.

Thereafter, the FLCD 110 continues the processing for the Set Multi command, i.e., waits for the response status to the Set Multi command from the FLCD.

The above sequences are described by taking some commands and attentions as examples. However, it will be readily understood from the above description that substantially identical sequences are followed for other commands and attentions. Therefore, no further explanation of sequences will be given below.

Operations of turning on of the FLCD 109 and turning on of the FLCD-I/F 110 (which is also turning on of the information processing apparatus) in this embodiment will be described below.

Generally, it makes no difference whether an information processing apparatus (e.g., a personal computer) and its display device are integrated or separated. This is so because the display device merely displays output image data from the host apparatus, i.e., there is no communication between them.

A problem arises, however, if the FLCD 109 has some intelligence as in this embodiment and so it is desirable that the display device and the host device perform processing while checking the respective conditions.

This embodiment has solved this problem in the following manner.

As described previously, the data transfer bus 310 includes one signal line which indicates whether the FLCD-I/F 110 is turned on. This embodiment uses this signal line.

Details of the operation are as follows.

Case 1. The FLCD-I/F 110 is turned on first, and then the FLCD 109 is turned on.

In this case, in the initialization stage upon turning on the FLCD 109 can detect that the FLCD-I/F 110 is turned on, on the basis of one signal line (power ON signal line) of the data transfer bus 310. Therefore, when the FLCD 109 detects this and the self-initialization is completed, the FLCD 109 sends a spontaneous attention (10000001B which indicates that the FLCD 109 is in a ready state) to the FLCD-I/F 110.

By receiving this attention, the FLCD-I/F 110 is informed that the FLCD 109 is operable. Accordingly, the FLCD-I/F 110 issues the Attention Clear command and causes the FLCD 109 to display images after receiving an attention "00000000B" from the FLCD 109.

In practice, however, the turn-on operation of the FLCD 109 sends an attention in which a bit, which indicates that it is intended to transmit the contrast value and the value of one scan driving period upon turning on, is set to "1", rather than an attention simply indicating the Ready state. Therefore, the FLCD-I/F 110 issues transmission requests for the contrast value and the value of one scan driving period and performs processing of acquiring each information.

Case 2. The FLCD 109 is turned on first, and then the FLCD-I/F 110 is turned on (e.g., when the FLCD 109 as a display device is left ON although the information processing apparatus is turned off).

If this is the case, the Power On signal is enabled after the FLCD-I/F 110 is initialized. When the signal is enabled, the FLCD 109 performs initialization such as turning-on of the back light. After the initialization, the FLCD 109 sends UNIT READY.

Figure 24:
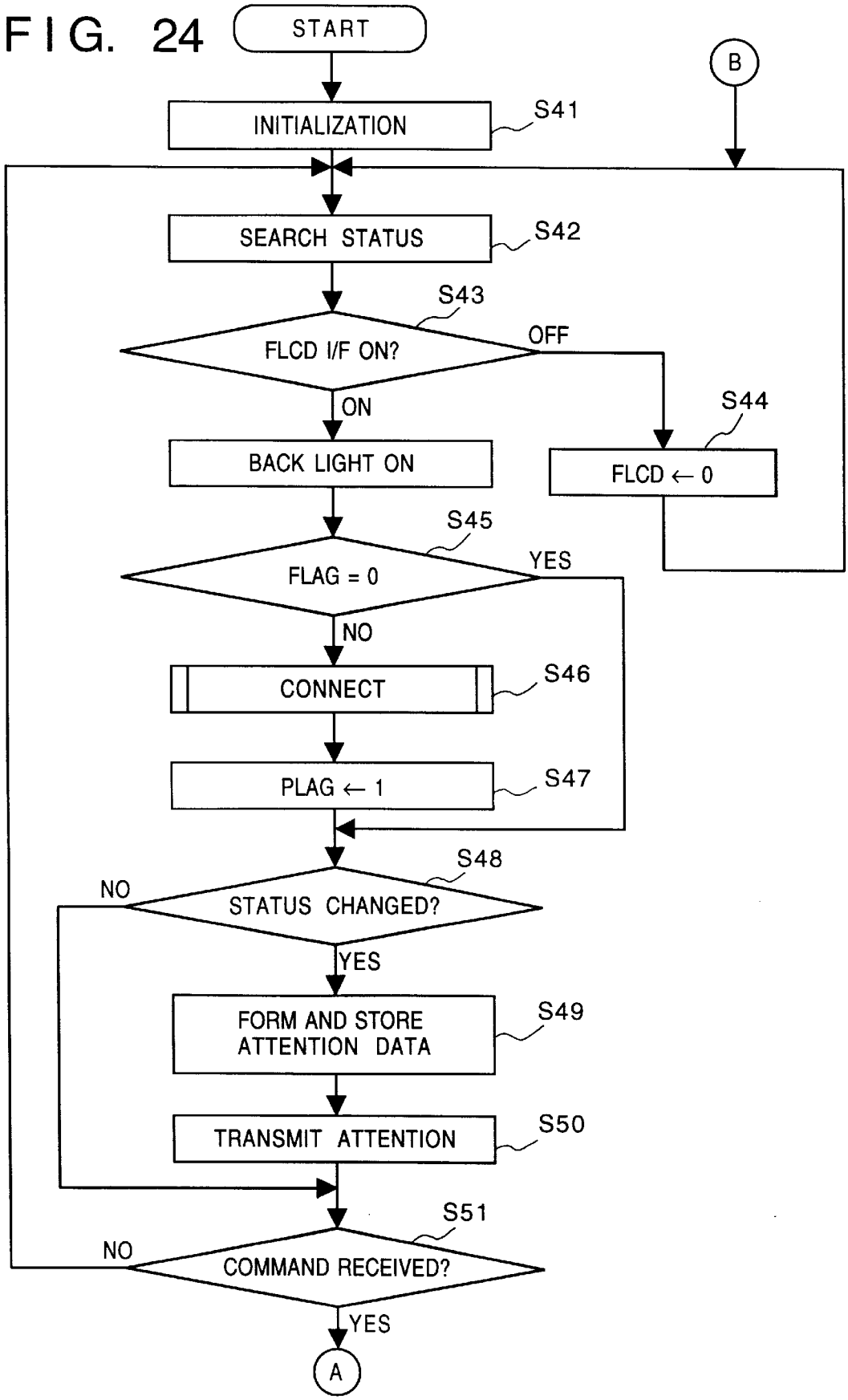
FIG. 24 is a flow chart showing a part of the operation processing contents of the FLCD in the fourth embodiment.
Figure 25:
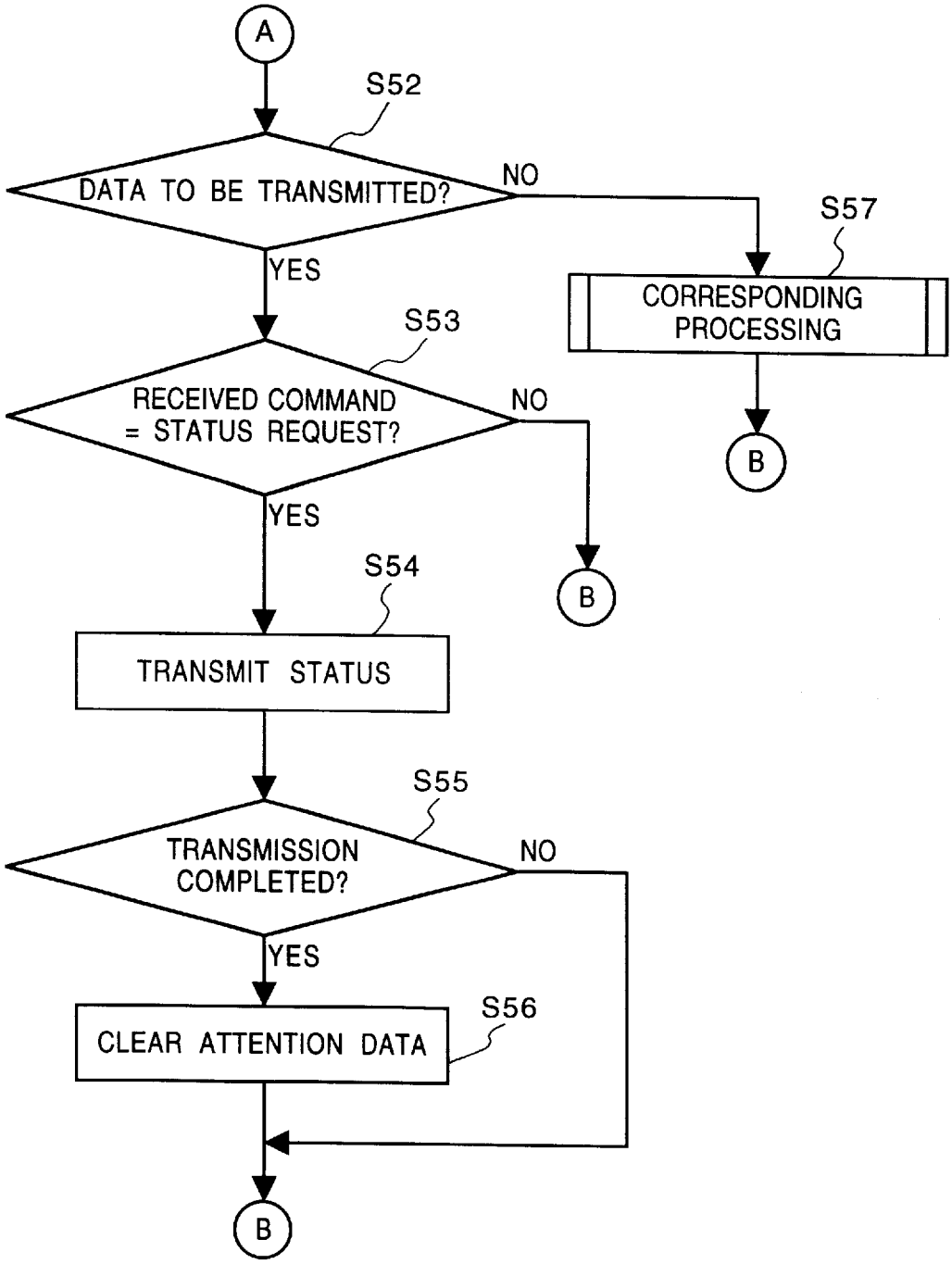
FIG. 25 is a flow chart showing another part of the operation processing contents of the FLCD in the fourth embodiment.

The operation procedures of the CPU 109*a* of the FLCD 109 will be described below with reference to the flow charts shown in FIGS. 24 and 25. Note that programs corresponding to these flow charts are stored in an internal ROM (not shown) of the CPU 109*a*. Although this ROM also stores processing programs corresponding to data reception from the data transfer bus 310, a description of the processing will be omitted since it is readily possible to understand the processing from the following description.

When the FLCD 109 is turned on by a switch (not shown), the CPU 109*a* first initializes the individual circuits in the FLCD 109 in step S41. This initialization includes processing of storing a variable FLAG (to be described later) into a RAM (not shown) and clearing FLAG to "0".

The flow advances to step S42, and the CPU 109*a* searches various statuses in the FLCD 109. The present states of the temperature sensor 407 and the contrast adjusting unit 406 are examples of the objects to be searched.

In step S43, the CPU 109*a* detects the logical level of a specific line of the data transfer bus 310, thereby checking whether the FLCD-I/F 110 is turned on.

If the CPU 109*a* determines in step S43 that the FLCD-I/F 110 is not turned on, the CPU 109*a* sets FLAG to "0", and the flow advances to step S51.

If the CPU 109*a* determines in step S43 that the FLCD-I/F 110 is turned on, the flow advances to step S45, and the CPU 109*a* checks whether FLAG is "0", i.e., whether the FLCD-I/F 110 is switched from OFF to ON (when the FLCD 109 is turned on first).

If FLAG is "0", to inform the FLCD-I/F 110 that the FLCD 109 is drivable, the CPU 109*a* issues a spontaneous attention indicating this information to the FLCD-I/F 110. However, during loop processing performed while the FLCD-I/F 110 is kept off, the CPU 109*a* also acquires a status. In this case, therefore, the CPU 109*a* issues, to the FLCD-I/F 110, an attention which includes a bit indicating that the value of one scan driving period and the contrast value are changed.

The FLCD-I/F 110 receives this attention and issues the corresponding command. Finally, a connection between the FLCD-I/F 110 and the FLCD 109 is completed by issue of the Attention Clear command from the FLCD-I/F 110 and issue of the attention "00000000B" from the FLCD 109. This processing is done in step S46.

When the connection between the FLCD-I/F 110 and the FLCD 109 is completed in this way, the flow advances to step S47, and the CPU 109*a* sets "1" in FLAG.

The flow then advances to step S48, and the CPU 109*a* compares the status (the temperature value from the temperature sensor 407 and the value from the contrast adjusting unit 406) obtained in step S42 with the last status, checking whether the status is changed.

If YES in step S48, the flow advances to step S49, and the CPU 109*a* forms data to be transmitted by a spontaneous attention and stores the data in the RAM (not shown). Assume this data is stored in a FIFO manner. In step S50, the CPU 109*a* transmits a spontaneous attention indicating the changed status to the FLCD-I/F 110 through the serial communication line 210. At this point the value of a scan driving period depending on the temperature and the contrast value are untransmitted.

In step S51, the CPU 109*a* checks whether a command is received from the FLCD-I/F 110. If no command is received, the flow returns to step S42.

If a command is received from the FLCD-I/F 110, the flow advances to step S52, and the CPU 109*a* checks whether the data to be transmitted, which is formed and stored previously, is completely transmitted. If, for example, a spontaneous attention indicating that the contrast is changed is already issued but information indicating the actual state has not been completely transmitted yet, the flow advances to step S53, and the CPU 109*a* checks whether the received data (command) requests the state (Request Attention Inf.) If NO in step S53, the CPU 109*a* determines that the received command is issued by the FLCD-I/F 110 simultaneously with the attention. Accordingly, the flow returns to step S42 by neglecting the command.

If the CPU 109*a* determines in step S53 that the received command is a status transmission request, the flow advances to step S54. In step S54, the CPU 109*a* constructs an attention code based on the data to be transmitted and transmits the code.

In step S55, the CPU 109*a* checks whether the data based on the issue of the spontaneous attention is completely transmitted. If YES in step S55, the CPU 109*a* clears the stored data portion (step S56). If NO in step S55, the CPU 109*a* prepares for reception of the next request command.

On the other hand, if the CPU 109*a* determines in step S52 that there remains no data to be transmitted, the CPU 109*a* can determine that the received command is not the response command to the spontaneous attention from the FLCD 109. Therefore, the flow advances to step S57, and the CPU 109*a* performs the corresponding processing.

The processing done in step S57 includes not only processing for the requested command but processing (corresponding to step S49) of storing the response data to the request. The CPU 109*a* also performs similar processing when an error occurs in the received data.

Note that the FLCD-I/F 110 issues a command for the first event in step S3 or S5 in the main processing. Also, transmission of commands after the first command is issued is done by interrupt processing upon reception from the serial communication line 210.

A description of this interrupt processing will be omitted because the processing can be readily understood from the above explanation of the commands and attentions and by referring to the sequences shown in FIGS. 21 to 23.

Note that the FLCD-I/F 110 or the FLCD 109 in this embodiment can be previously integrated with the information processing apparatus or mounted in a standard extension slot of an apparatus represented by a personal computer.

Note also that in the above embodiment, the CPU 204 of the FLCD-I/F 110 performs processing in accordance with the programs stored in the ROM 220. However, in place of the ROM 220, it is possible to use, e.g., a RAM or an EEPROM in which data can be rewritten and stored.

When a RAM is used, it is only necessary to down-load a corresponding program into the CPU 204 of the FLCD-I/F 110 in the early stages of driver software for driving the FLCD-I/F 110 when the information processing apparatus is turned on. The use of a RAM or an EEPROM has the advantage that the process programs of the CPU 204 are easily changed and debugged.

Accordingly, the information processing apparatus or the FLCD-I/F of this embodiment can be either a single apparatus or a combination of a plurality of apparatuses or can be realized by externally supplying programs.

The present invention, therefore, is not limited to the above embodiments but applicable to any system as long as the gist of the invention is not altered.

The above embodiments have been described by taking an FLCD, i.e., a ferroelectric liquid crystal display, as an example. Also, the number of colors to be displayed is 16 colors. However, the present invention can be applied to any apparatus as long as the apparatus can hold display images. Therefore, the display device is not restricted to an FLCD, and the number of display colors is not limited to 16 colors.

In the above embodiments, the FLCD-I/F 110 and the FLCD 109 are connected through two interfaces, i.e., the dedicated bus 310 for image data and the serial communication line 210 for exchanging commands and attentions. Actually, however, these interfaces are connected as they are accommodated in a single cable. Accordingly, a user recognizes as if the data exchange appeared to be performed through a single interface, and this avoids confusion of wiring.

Note that in the above description, the fourth embodiment is applied to the second embodiment described previously. However, it is of course possible to apply the fourth embodiment to the first or the third embodiment.

As an example, to apply the fourth embodiment to the first embodiment, it is only necessary to change each element value in the error diffusion matrix in the binarizing halftone processor 206 in accordance with an instruction from the FLCD 109. To apply the fourth embodiment to the third embodiment, on the other hand, it is only necessary to additionally provide two adjustment switches and change the characteristics of the degamma processor 601 or the binarizing halftone processor 206 when an operator adjusts the corresponding switch.

According to the embodiments of the present invention as described above, images can be displayed while the display side and the display image transfer side communicate with each other. Consequently, it is possible to cause the display side to display images in an optimum state corresponding to the conditions of the display side.

The present invention can be applied to a system constituted by a plurality of devices or to an apparatus comprising a single device.

Furthermore, the invention is applicable also to a case where the invention is embodied by supplying a program to a system or apparatus. In this case, a storage medium, storing a program according to the invention constitutes the invention. The system or apparatus installed with the program read from the medium realizes the functions according to the invention.

As many apparently widely different embodiments of the present invention can be made without departing from the spirit and scope thereof, it is to be understood that the invention is not limited to the specific embodiments thereof except as defined in the appended claims.

What is claimed is:

1. A display control apparatus for controlling a display for displaying transferred image data while communicating with an external apparatus, comprising:

image data transfer means for transferring a display image to said display through a first bus; and communicating means for bidirectionally transmitting and receiving data to and from said display through a second bus, wherein status information from said display is received and a command for changing a driving state of said display is transmitted through said second bus, wherein said display comprises at least detecting means for detecting a temperature near a display element and contrast changing means for changing a contrast of a display screen, and wherein the status information includes information based on the detected temperature and information based on the changed contrast.

2. The apparatus according to claim 1, wherein said display control apparatus is connected to an extended bus provided in a general-purpose information processing apparatus.

3. The apparatus according to claim 1, wherein said display is a device having a function of holding an image display state.

4. The apparatus according to claim 3, further comprising:

first storage means for storing original image data of a display image;

second storage means for storing data having a display format of said display;

monitoring means for monitoring an access to said first storage means;

converting means for, if said monitoring means detects that write access is performed to said first storage means, converting image data in the written area into the display data format of said display;

storing means for storing the converted image data into said second storage means;

determining means for determining whether said second storage means has an image untransferred to said display; and output means for, if said determining means determines that said second storage means has an untransferred image, outputting the image to said display through said first bus.

5. The apparatus according to claim 4, wherein said output means comprises means for transferring all images stored in said second storage means at a ratio based on the status information from said display within a predetermined time.

6. The apparatus according to claim 4, wherein said second storage means has a capacity of a full-screen image displayed by said display, and further comprising second output means for outputting all images stored in said storage means to said display through said first bus, if said determining means determines that said second storage means has no untransferred image.

7. The apparatus according to claim 6, wherein said second output means performs interlaced scanning of images stored in said second storage means and outputs the scanned images to said display.

8. The apparatus according to claim 3, wherein said display is a ferroelectric liquid crystal display.

9. The apparatus according to claim 1, wherein said second bus is a serial bus.

10. A display control apparatus for controlling a display for displaying transferred image data while communicating with an external apparatus, comprising:

image data transfer means for transferring a display image to said display through a first bus;

communicating means for bidirectionally transmitting and receiving data to and from said display through a second bus; and changing means for changing an image processing parameter on the basis of the status information from said display, wherein status information from said display is received and a command for changing a driving state of said display is transmitted through said second bus apparatus, and wherein the image processing parameter is a coefficient for degamma processing.

11. The apparatus according to claim 10, wherein said second bus is a serial bus.

12. The apparatus according to claim 10, wherein said display is a device having a function of holding an image display state.

13. The apparatus according to claim 12, wherein said display is a ferroelectric liquid crystal display.

14. The apparatus according to claim 12, further comprising:

first storage means for storing original image data of a display image;

second storage means for storing data having a display format of said display;

monitoring means for monitoring an access to said first storage means;

converting means for, if said monitoring means detects that write access is performed to said first storage means, converting image data in the written area into the display data format of said display;

storing means for storing the converted image data into said second storage means;

determining means for determining whether said second storage means has an image untransferred to said display; and output means for, if said determining means determines that said second storage means has an untransferred image, outputting the image to said display through said first bus.

15. The apparatus according to claim 14, wherein said output means comprises means for transferring all images stored in said second storage means at a ratio based on the status information from said display within a predetermined time.

16. The apparatus according to claim 14, wherein said second storage means has a capacity of a full-screen image displayed by said display, and further comprising second output means for outputting all images stored in said storage means to said display through said first bus, if said determining means determines that said second storage means has no untransferred image.

17. The apparatus according to claim 16, wherein said second output means performs interlaced scanning of images stored in said second storage means and outputs the scanned images to said display.

18. The apparatus according to claim 10, wherein said display control apparatus is connected to an extended bus provided in a general-purpose information processing apparatus.

19. A display control apparatus for controlling a display for displaying transferred image data while communicating with an external apparatus, comprising:

image data transfer means for transferring a display image to said display through a first bus;

communicating means for bidirectionally transmitting and receiving data to and from said display through a second bus; and changing means for changing an image processing parameter on the basis of the status information from said display, wherein status information from said display is received and a command for changing a driving state of said display is transmitted through said second bus apparatus, and wherein the image processing parameter is a coefficient for error diffusion processing.

20. The apparatus according to claim 19, wherein said second bus is a serial bus.

21. The apparatus according to claim 19, wherein said display is a device having a function of holding an image display state.

22. The apparatus according to claim 21, wherein said display is a ferroelectric liquid crystal display.

23. The apparatus according to claim 21, further comprising:

first storage means for storing original image data of a display image;

second storage means for storing data having a display format of said display;

monitoring means for monitoring an access to said first storage means;

converting means for, if said monitoring means detects that write access is performed to said first storage means, converting image data in the written area into the display data format of said display;

storing means for storing the converted image data into said second storage means;

determining means for determining whether said second storage means has an image untransferred to said display; and output means for, if said determining means determines that said second storage means has an untransferred image, outputting the image to said display through said first bus.

24. The apparatus according to claim 23, wherein said second storage means has a capacity of a full-screen image displayed by said display, and further comprising second output means for outputting all images stored in said storage means to said display through said first bus, if said determining means determines that said second storage means has no untransferred image.

25. The apparatus according to claim 24, wherein said second output means performs interlaced scanning of images stored in said second storage means and outputs the scanned images to said display.

26. The apparatus according to claim 25, wherein said output means comprises means for transferring all images stored in said second storage means at a ratio based on the status information from said display within a predetermined time.

27. The apparatus according to claim 19, wherein said display control apparatus is connected to an extended bus provided in a general-purpose information processing apparatus.

28. An information processing apparatus, comprising:

a display; and a display control apparatus for controlling a display state of said display, wherein a first bus for transferring a display image from said display control apparatus to said display and a second bus for bidirectionally performing communication between said display control apparatus and said display are provided between said display and said display control apparatus, wherein said display control apparatus receives status information from said display and transmits a command for changing a driving state to said display through said second bus, wherein said display comprises at least detecting means for detecting a temperature near a display element and contrast changing means for changing a contrast of a display screen, and wherein the status information includes information based on the detected temperature and information based on the changed contrast.

29. The apparatus according to claim 28, wherein said display control apparatus is connected to an extended bus provided in a general-purpose information processing apparatus.

30. The apparatus according to claim 28, wherein said display is a device having a function of holding an image display state.

31. The apparatus according to claim 30, wherein said display is a ferroelectric liquid crystal display.

32. The apparatus according to claim 30, wherein said display control apparatus further comprises:

first storage means for storing original image data of a display image;

second storage means for storing data having a display format of said display;

monitoring means for monitoring an access to said first storage means;

converting means for, if said monitoring means detects that a write is performed for said first storage means, converting image data in the written area into the display data format of said display;

storing means for storing the converted image data into said second storage means;

determining means for determining whether said second storage means has an image untransferred to said display;

output means for, if said determining means determines that said second storage means has an untransferred image, outputting the image to said display through said first bus.

33. The apparatus according to claim 32, wherein said second storage means of said display control apparatus has a capacity of a full-screen image displayed by said display, and further comprising second output means for outputting all images stored in said storage means to said display through said first bus, if said determining means determines that said second storage means has no untransferred image.

34. The apparatus according to claim 33, wherein said second output means performs interlaced scanning of images stored in said second storage means and outputs the scanned images to said display.

35. The apparatus according to claim 32, wherein said output means comprises means for transferring all images stored in said second storage means at a ratio based on the status information from said display within a predetermined time.

36. The apparatus according to claim 28, wherein said second bus is a serial bus.

37. An information processing apparatus, comprising:

a display; and a display control apparatus for controlling a display state of said display, wherein a first bus for transferring a display image from said display control apparatus to said display and a second bus for bidirectionally performing communication between said display control apparatus and said display are provided between said display and said display control apparatus, wherein said display control apparatus receives status information from said display and transmits a command for changing a driving state to said display through said second bus, wherein said display control apparatus further comprises changing means for changing an image processing parameter on the basis of the status information from said display, and wherein the image processing parameter is a coefficient for degamma processing.

38. An information processing apparatus, comprising:

a display; and a display control apparatus for controlling a display state of said display, wherein a first bus for transferring a display image from said display control apparatus to said display and a second bus for bidirectionally performing communication between said display control apparatus and said display are provided between said display and said display control apparatus, wherein said display control apparatus receives status information from said display and transmits a command for changing a driving state to said display through said second bus, wherein said display control apparatus further comprises changing means for changing an image processing parameter on the basis of the status information from said display, and wherein the image processing parameter is a coefficient for error diffusion processing.

39. A display device for displaying an image based on an image transferred from a host apparatus, comprising:

a first bus for receiving the image from said host apparatus;

a second bus for bidirectionally communicating with said host apparatus;

control means for controlling a display state in accordance with an instruction sent through said second bus, and, if a change in a display driving state is detected, transferring information of the driving state to said host apparatus through said second bus; and detecting means for detecting a temperature near a display element and contrast changing means for changing a contrast of a display screen, wherein said control means transfers information based on the detected temperature and information based on the changed contrast to said host apparatus.

40. The device according to claim 39, wherein said second bus is a serial bus.

41. The display according to claim 39, wherein said display is a device having a function of holding an image display state.

42. The device according to claim 41, wherein said display is a ferroelectric liquid crystal display.

43. The device according to claim 39, wherein said host apparatus is a display interface mounted in a general-purpose information processing apparatus.

44. A display control system, having an image supply device for supplying image information while performing image processing, and an image display device for displaying the image information supplied from said image supply device, comprising:

input means, provided in said image display device for inputting an image adjustment instruction signal;

transfer means for transferring the input image adjustment instruction signal from said input means to said image supply device; and changing means, provided in said image supply device, for changing an image processing parameter on the basis of the transferred image adjustment instruction signal from said transfer means, wherein the image processing parameter is a coefficient for degamma processing.

45. The system according to claim 44, wherein said transfer means transfers the image adjustment instruction signal by parallel communication.

46. The system according to claim 44, wherein said transfer means transfers the image adjustment instruction signal by serial communication.

47. A display control system, having an image supply device for supplying image information while performing image processing, and an image display device for displaying the image information supplied from said image supply device, comprising:

input means, provided in said image display device for inputting an image adjustment instruction signal;

transfer means for transferring the input image adjustment instruction signal from said input means to said image supply device; and changing means, provided in said image supply device, for changing an image Processing parameter on the basis of the transferred image adjustment instruction signal from said transfer means, wherein the image processing parameter is a coefficient for error diffusion processing.

48. The system according to claim 47, wherein said transfer means transfers the image adjustment instruction signal by parallel communication.

49. The system according to claim 47, wherein said transfer means transfers the image adjustment instruction signal by serial communication.

50. A method for controlling a display for displaying transferred image data while communicating with an external apparatus, wherein the display comprises at least detecting means for detecting a temperature near a display element and contrast changing means for changing a contrast of a display screen, and wherein the status information includes information based on the detected temperature and information based on the changed contrast, said method comprising the steps of:

transferring a display image to the display through a first bus; and bidirectionally transmitting and receiving data to and from the display through a second bus, wherein status information from the display is received and a command for changing a driving state of the display is transmitted through the second bus.

51. A method for controlling a display for displaying transferred image data while communicating with an external apparatus, comprising the steps of:

transferring a display image to the display through a first bus;

bidirectionally transmitting and receiving data to and from the display through a second bus; and changing an image processing parameter on the basis of the status information from the display, wherein status information from the display is received and a command for changing a driving state of the display is transmitted through the second bus, and wherein the image processing parameter is a coefficient for degamma processing.

52. A method for controlling a display for displaying transferred image data while communicating with an external apparatus, comprising the steps of:

transferring a display image to the display through a first bus;

bidirectionally transmitting and receiving data to and from the display through a second bus; and changing an image processing parameter on the basis of the status information from the display, wherein status information from the display is received and a command for changing a driving state of the display is transmitted through the second bus, and wherein the image processing parameter is a coefficient for error diffusion processing.

53. A display control apparatus for controlling a display for displaying transferred image data while communicating with an external apparatus, comprising:

image data transfer means for transferring a display image to said display through a first bus;

communicating means for bidirectionally transmitting and receiving data to and from said display through a second bus; and changing means for changing an image processing parameter on the basis of the status information from said display, wherein status information from said display is received and a command for changing a driving state of said display is transmitted through said second bus apparatus, and wherein the image processing parameter is a coefficient for halftone processing.

54. A method for controlling a display for displaying transferred image data while communicating with an external apparatus, comprising the steps of:

transferring a display image to the display through a first bus;

bidirectionally transmitting and receiving data to and from the display through a second bus; and changing an image processing parameter on the basis of the status information from the display, wherein status information from the display is received and a command for changing a driving state of the display is transmitted through the second bus, and wherein the image processing parameter is a coefficient for halftone processing.

* * * * *

UNITED STATES PATENT AND TRADEMARK OFFICE

CERTIFICATE OF CORRECTION

PATENT NO. : 5,880,702

DATED : March 9, 1999

INVENTOR(S): HAJIME MORIMOTO, ET AL.

It is certified that error appears in the above-identified patent and that said Letters Patent is hereby corrected as shown below:

COLUMN 12

Line 11, "of" (first occurrence) should be deleted; and
Line 13, "≅4M-bytes)." should read --≅ 4 Mbytes).--.

COLUMN 14

Line 18, "tc," should read --to--;
Line 57, "linesnot" should read --lines not--;
Line 62, "This" should read --The reason for this--; and
Line 63, "reason" should be deleted.

COLUMN 16

Line 22, "lines" should read --the lines--.

COLUMN 19

Line 8, "Si." should read --S1.--.

UNITED STATES PATENT AND TRADEMARK OFFICE

CERTIFICATE OF CORRECTION

PATENT NO. : 5,880,702

DATED : March 9, 1999

INVENTOR(S): HAJIME MORIMOTO, ET AL.

It is certified that error appears in the above-identified patent and that said Letters Patent is hereby corrected as shown below:

COLUMN 20

Line 10, "if" should read --If--.

COLUMN 24

Line 30, "Ready" should read --READY--.

COLUMN 25

Line 42, ""Get Model"" should read --"Get Mode"--.

COLUMN 28

Line 55, "Ready" should read --READY--; and
Line 63, "off" should read --OFF--.

UNITED STATES PATENT AND TRADEMARK OFFICE

CERTIFICATE OF CORRECTION

PATENT NO. : 5,880,702

DATED : March 9, 1999

INVENTOR(S): HAJIME MORIMOTO, ET AL.

It is certified that error appears in the above-identified patent and that said Letters Patent is hereby corrected as shown below:

COLUMN 37

```
Line 24, "Processing" should read --processing--;
Line 41, "wherein the" should read --wherein--; and
Line 49, "wherein status" should read
        --wherein the status--.
```

Signed and Sealed this

Fourth Day of July, 2000

*Attest:*

*Attesting Officer*

Q. TODD DICKINSON

*Director of Patents and Trademarks*